US010982690B2

(12) United States Patent
Arai

(10) Patent No.: US 10,982,690 B2
(45) **Date of Patent: *Apr. 20, 2021**

(54) CYLINDER DEVICE, PRESS MACHINE, WORKPIECE CLAMPING APPARATUS, CYLINDER DEVICE ACTUATING METHOD, METHOD FOR CLAMPING WORKPIECE, AND METHOD FOR PRESSING WORKPIECE

(71) Applicant: Seiko Instruments Inc., Chiba (JP)

(72) Inventor: Shigehiro Arai, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 433 days.

This patent is subject to a terminal disclaimer.

(21) Appl. No.: 15/921,981

(22) Filed: Mar. 15, 2018

(65) Prior Publication Data

US 2018/0266446 A1 Sep. 20, 2018

(30) Foreign Application Priority Data

Mar. 15, 2017 (JP) ..... JP2017-049308
Feb. 9, 2018 (JP) ..... JP2018-021723

(51) Int. Cl.
*F15B 3/00* (2006.01)
*B21D 22/20* (2006.01)
(Continued)

(52) U.S. Cl.
CPC ..... *F15B 3/00* (2013.01); *B21D 22/205* (2013.01); *B21D 28/002* (2013.01); *B30B 1/32* (2013.01);
(Continued)

(58) Field of Classification Search
CPC ..... B30B 1/32; B30B 15/161; B30B 15/165; B30B 15/168; B30B 1/38; F15B 3/00;
(Continued)

(56) References Cited

U.S. PATENT DOCUMENTS 3,511,048 A * 5/1970 Nemetz ..... F15B 11/0325 60/565
4,993,226 A * 2/1991 De Kok ..... F15B 11/0325 60/547.1
5,377,488 A * 1/1995 Malina ..... F15B 11/0325 60/560
5,582,009 A * 12/1996 Brieschke ..... F15B 3/00 60/560
(Continued)

FOREIGN PATENT DOCUMENTS

JP 4895342 B2 3/2012

*Primary Examiner* — Shelley M Self
*Assistant Examiner* — Jared O Brown
(74) *Attorney, Agent, or Firm* — Brinks Gilson & Lione

(57) ABSTRACT

A pneumatic chamber 20 is configured to include a first pneumatic chamber 21 pressurizing a first piston 11 and a second pneumatic chamber 22 pressurizing a second piston 12. The first pneumatic chamber 21 communicates with the second pneumatic chamber 22. The hydraulic pressure generating unit 55 is internally provided with a hydraulic chamber 30, and the hydraulic chamber 30 is configured to have a first hydraulic chamber 31 pressurized by the first pneumatic chamber 21 via the first piston 11 and a second hydraulic chamber 32 pressurized by the second pneumatic chamber 22 via the second piston 12. The hydraulic pressure generating unit 55 is movable in a thrust direction in a cylinder 2, and the second hydraulic chamber 32 has a function of fixing the moving hydraulic pressure generating unit 55 in the cylinder 2 by causing a thin portion 15 to be elastically deformed in a radial direction due to hydraulic pressure. The first hydraulic chamber 31 outputs hydraulic pressure of the first hydraulic chamber 31, which is increased by the fixing, to an output rod 7.

26 Claims, 13 Drawing Sheets

(51) Int. Cl.

| | |
|---|---|
| ***B30B 1/38*** | (2006.01) |
| ***B21D 24/00*** | (2006.01) |
| ***B21D 28/00*** | (2006.01) |
| ***B30B 15/16*** | (2006.01) |
| ***B30B 1/32*** | (2006.01) |
| *B21D 22/22* | (2006.01) |

(52) U.S. Cl.
CPC ..... *B30B 1/38* (2013.01); *B30B 15/165* (2013.01); *B21D 22/22* (2013.01); *B21D 24/005* (2013.01)

(58) Field of Classification Search
CPC ..... F15B 2211/7055; B21D 22/205; B21D 24/005; B23P 19/027
USPC ..... 91/4 R
See application file for complete search history.

(56) References Cited

U.S. PATENT DOCUMENTS

| | | | | |
|---|---|---|---|---|
| 5,649,424 | A * | 7/1997 | Valavaara | F15B 3/00 60/560 |
| 5,865,029 | A * | 2/1999 | Brieschke | F15B 11/032 60/560 |
| 6,735,944 | B2 * | 5/2004 | Sawdon | B21J 15/22 60/560 |
| 6,779,343 | B2 * | 8/2004 | Sawdon | B21J 15/22 60/560 |
| 2006/0073037 | A1 * | 4/2006 | Pedersen | F15B 3/00 417/415 |
| 2010/0121496 | A1 * | 5/2010 | Paulus | F15B 9/09 700/282 |
| 2015/0075157 | A1 * | 3/2015 | Gresser | F15B 11/032 60/560 |

* cited by examiner (a)

(1)RETREATING (2)AIR DRIVE (3)HYDRAULIC DRIVE (4)AIR DRIVE (b)

(1)RETREATING (2)AIR DRIVE (3)HYDRAULIC DRIVE (4)AIR DRIVE (a)

(b)

(c)

CYLINDER DEVICE, PRESS MACHINE, WORKPIECE CLAMPING APPARATUS, CYLINDER DEVICE ACTUATING METHOD, METHOD FOR CLAMPING WORKPIECE, AND METHOD FOR PRESSING WORKPIECE

RELATED APPLICATIONS

This application claims priority under 35 U.S.C. § 119 to Japanese Patent Application Nos. 2017-049308 filed Mar. 15, 2017 and 2018-021723 filed Feb. 9, 2018, the entire content of which are hereby incorporated by reference.

BACKGROUND OF THE INVENTION

Field of the Invention

The present invention relates to a cylinder device, a press machine, a workpiece clamping apparatus, a cylinder device actuating method, a method for clamping workpiece, and a method for pressing workpiece, such as a technology in which a fluid pressure cylinder is used.

Background Art

A fluid pressure cylinder using a fluid such as air (a gas) or oil (a liquid) is used in many industrial fields.

The fluid pressure cylinder generates thrust on a piston in a cylinder due to pressure of a fluid such that the thrust can be a drive force of various types of mechanical actuation such as driving of a press or an actuator.

However, a hydraulic cylinder has a characteristic in that even a small hydraulic cylinder generates large thrust due to a high pressure force by hydraulic pressure; however, a problem arises in that large-scale equipment such as a hydraulic pressure supply device is required.

Therefore, Japanese Patent No. 4895342 proposes a fluid pressure cylinder that generates hydraulic pressure with air pressure by an air hydraulic cylinder obtained by combining an air cylinder and a hydraulic cylinder such that a complex hydraulic system is omitted and the fluid pressure cylinder can be decreased in costs and size.

However, in a technology in Japanese Patent No. 4895342, the thrust is generated by a movement distance of a piston of the air cylinder with a sectional area of the hydraulic cylinder, and thus a problem of a short stroke arises.

For example, in a case where an actuator is disposed on an output side of the air hydraulic cylinder, it is necessary to cause the actuator to move along with the air hydraulic cylinder in order to secure a stroke.

SUMMARY OF THE INVENTION

According to an aspect of the invention, an object thereof is to provide a cylinder device having a long stroke by using an air hydraulic cylinder.

According to a first aspect of the invention, in order to achieve the object described above, there is provided a cylinder device including: a cylinder; a pneumatic chamber formed on one end side in the cylinder; a hydraulic chamber that moves to the other end side in the cylinder due to pressure of the pneumatic chamber; fixing means for generating a force in a radial direction from a force in a thrust direction, which is applied to the hydraulic chamber by the pneumatic chamber, and fixing the hydraulic chamber in the cylinder due to the force in the radial direction; hydraulic pressure amplifying means for amplifying hydraulic pressure that is generated in the fixed hydraulic chamber by the pneumatic chamber; and an output rod that outputs the amplified hydraulic pressure.

According to a second aspect of the invention, in the cylinder device of the first aspect, the hydraulic chamber may generate hydraulic pressure by receiving a force in a direction to the other end side, which is applied to the hydraulic chamber by the pneumatic chamber, and a force in a direction to the one end side, which is applied to the hydraulic chamber by the output rod.

According to a third aspect of the invention, in the cylinder device of the first or second aspect, the hydraulic chamber may be configured to include a first hydraulic chamber provided with the output rod and a second hydraulic chamber provided with the fixing means, the fixing means may fix the second hydraulic chamber and the first hydraulic chamber by generating the force in the radial direction due to hydraulic pressure of the second hydraulic chamber, and the hydraulic pressure amplifying means may amplify hydraulic pressure generated in the first hydraulic chamber and may output the hydraulic pressure to the output rod.

According to a fourth aspect of the invention, in the cylinder device of the third aspect, the fixing means may fix the second hydraulic chamber and the first hydraulic chamber by pressing, to an inner wall of the cylinder, a side wall of the second hydraulic chamber that is elastically deformed due to the force in the radial direction.

According to a fifth aspect of the invention, in the cylinder device of the third aspect, the fixing means may generate the force in a radial direction by pressing, to a clamper, a taper member moving in a thrust direction, due to the hydraulic pressure generated in the second hydraulic chamber, and may fix the second hydraulic chamber and the first hydraulic chamber by pressing the clamper to an inner wall of the cylinder by the force.

According to a sixth aspect of the invention, in the cylinder device of the third, fourth, or fifth aspect, the first hydraulic chamber may have an output piston pressing the output rod in an output direction, the cylinder device further including: biasing means that biases the output piston in a direction opposite to the output direction.

According to a seventh aspect of the invention, in the cylinder device of the sixth aspect, the output piston of the first hydraulic chamber may transmit only an output to the output rod without moving even in a state in which hydraulic pressure generated by being amplified in the first hydraulic chamber is applied to the output rod and thrust is output.

According to an eighth aspect of the invention, in the cylinder device of any one of the third to seventh aspects, the pneumatic chamber may be configured to include a first pneumatic chamber having a first piston that pressurizes the first hydraulic chamber, a second pneumatic chamber having a second piston that pressurizes the second hydraulic chamber, and a communication hole through which the first pneumatic chamber communicates with the second pneumatic chamber. The first pneumatic chamber may have a first inlet/outlet and may be formed on the one end side of the second pneumatic chamber.

According to a ninth aspect of the invention, in the cylinder device of the eighth aspect, the first piston may cause the second pneumatic chamber, the first hydraulic chamber, and the second hydraulic chamber to move to the other end side until the output rod abuts on a pressing target or until the first hydraulic chamber reaches an end portion on the other end side to which the first hydraulic chamber is movable, with pressure of the first pneumatic chamber.

According to a tenth aspect of the invention, in the cylinder device of the ninth aspect, a movement distance of the second piston measured when the second piston of the second hydraulic chamber generates hydraulic pressure amplified in the second hydraulic chamber may be within a range of a length of elastic deformation of a seal member of the second hydraulic chamber, which is disposed in the second piston.

According to an eleventh aspect of the invention, in the cylinder device of the ninth or tenth aspect, the first pneumatic chamber may be provided with a first inlet/outlet, and the first pneumatic chamber may communicate with the second pneumatic chamber through a communication hole.

According to a twelfth aspect of the invention, in the cylinder device of the ninth, tenth, or eleventh aspect, the first hydraulic chamber may be formed on the other end side of the second hydraulic chamber, and the first piston may be formed up to the first hydraulic chamber by penetrating through the second pneumatic chamber and the second hydraulic chamber.

According to a thirteenth aspect of the invention, the cylinder device of the eleventh or twelfth aspect may further include: a third pneumatic chamber that is provided on the other end side in the cylinder, has a second inlet/outlet, and presses the hydraulic chamber to the one end side.

According to a fourteenth aspect of the invention, the cylinder device of any one of the eighth to thirteenth aspects may further include: a pneumatic rod that is formed on the one end side of the cylinder from the first piston by penetrating through the first pneumatic chamber.

According to a fifteenth aspect of the invention, in the cylinder device of any one of the seventh to twelfth aspects, a rod portion of the first piston is divided into two rod portions provided with a predetermined clearance therebetween.

According to a sixteenth aspect of the invention, there is provided a press machine including: the cylinder device of the thirteenth aspect; workpiece mounting means for mounting a workpiece at a predetermined position with respect to the cylinder device; press means for pressing the mounted workpiece with a tool disposed on the output rod by driving the cylinder device; and detachment means for detaching the pressed workpiece from the predetermined position.

According to a seventeenth aspect of the invention, there is provided a workpiece clamping apparatus including: the cylinder device of the thirteenth aspect; workpiece mounting means for mounting a workpiece at a predetermined position with respect to the cylinder device; means for pressing and clamping the mounted workpiece with the output rod by driving the cylinder device; and detachment means for detaching the clamped workpiece from the predetermined position.

According to an eighteenth aspect of the invention, there is provided a cylinder device actuating method for actuating the cylinder device of the thirteenth aspect, the method including: a first step of setting an initial state by causing the first hydraulic chamber and the second hydraulic chamber to move to the one end side by pressurizing the third pneumatic chamber from the second inlet/outlet and depressurizing the first pneumatic chamber and the second pneumatic chamber from the first inlet/outlet; a second step of causing the output rod to abut on a pressing target or causing the first hydraulic chamber to reach the end portion on the other end side to which the first hydraulic chamber is movable by causing the first pneumatic chamber and the second pneumatic chamber to move to the other end side by pressurizing the first pneumatic chamber and the second pneumatic chamber from the first inlet/outlet and depressurizing the third pneumatic chamber from the second inlet/outlet; a third step of fixing the first hydraulic chamber and the second hydraulic chamber to the cylinder by further performing pressurization from the first inlet/outlet and actuating the fixing means; a fourth step of actuating the hydraulic pressure amplifying means by further performing pressurization from the first inlet/outlet and pressing the output rod to the pressing target; and a fifth step of returning to the initial state by causing the first hydraulic chamber and the second hydraulic chamber to move to the one end side by pressurizing the third pneumatic chamber from the second inlet/outlet and depressurizing the first pneumatic chamber and the second pneumatic chamber from the first inlet/outlet.

According to a nineteenth aspect of the invention, there is provided a method for clamping a workpiece at a predetermined position by actuating the cylinder device of the thirteenth aspect, the method including: a first step of mounting the workpiece at the predetermined position; a second step of driving the cylinder device and causing the cylinder device to move due to the pressure of the first pneumatic chamber, until the output rod abuts and stops on the workpiece or until the first hydraulic chamber reaches and stops on an end portion on the other end side to which the first hydraulic chamber is movable; a third step of fixing the first hydraulic chamber and the second hydraulic chamber by the fixing means; a fourth step of amplifying hydraulic pressure of the first hydraulic chamber by the hydraulic pressure amplifying means; and a fifth step of clamping the workpiece at a predetermined position by pressing the workpiece by the output rod due to the hydraulic pressure amplified in the fourth step.

According to a twentieth aspect of the invention, there is provided a method for pressing a workpiece by actuating the press machine of the sixteenth aspect, the method including: a first step of driving the cylinder device and returning a position of the output rod to an initial state; a second step of mounting the workpiece at a predetermined position; a third step of driving the cylinder device and causing the cylinder device to move due to the pressure of the first pneumatic chamber, until the output rod abuts and stops on the workpiece or until the first hydraulic chamber reaches and stops on an end portion on the other end side to which the first hydraulic chamber is movable; a fourth step of fixing the first hydraulic chamber and the second hydraulic chamber by the fixing means; a fifth step of amplifying hydraulic pressure of the first hydraulic chamber by the hydraulic pressure amplifying means; a sixth step of pressing the workpiece due to hydraulic pressure with a tool disposed on the output rod, due to the hydraulic pressure amplified in the fifth step, and pressing the workpiece; a seventh step of driving the cylinder device and detaching the output rod and the tool disposed on the output rod from the workpiece due to pneumatic pressure; and an eighth step of detaching the completely pressed workpiece from the predetermined position.

According to a twenty-first aspect of the invention, in the cylinder device of any one of the third to seventh aspects, the pneumatic chamber may be configured to include the first pneumatic chamber having the first piston that pressurizes the first hydraulic chamber and the second pneumatic chamber having the second piston that pressurizes the second hydraulic chamber. The second pneumatic chamber may be disposed on the one end side of the second hydraulic chamber, and the first pneumatic chamber may be disposed on the other end side of the second hydraulic chamber. The cylinder device may further include: a first inlet/outlet for pressurizing the second pneumatic chamber; and a third inlet/outlet for pressurizing the first pneumatic chamber by penetrating through the second pneumatic chamber and the second hydraulic chamber.

According to a twenty-second aspect of the invention, in the cylinder device of any one of the third to seventh aspects, the pneumatic chamber may be configured to include the first pneumatic chamber having the first piston that pressurizes the first hydraulic chamber and the second pneumatic chamber having the second piston that pressurizes the second hydraulic chamber. The second pneumatic chamber may be disposed on the one end side of the second hydraulic chamber, and the first pneumatic chamber may be disposed on the other end side of the second hydraulic chamber. The cylinder device may further include: a first inlet/outlet for pressurizing the second pneumatic chamber; and communicating means which penetrates through the second hydraulic chamber and through which the first pneumatic chamber and the second pneumatic chamber communicate with each other.

According to a twenty-third aspect of the invention, the cylinder device of the twenty-first or twenty-second aspect may further include: an input-side housing provided with the second hydraulic chamber; and an output-side housing provided with the first pneumatic chamber and the first hydraulic chamber. The input-side housing may be fixed to the output-side housing on the one end side.

According to a twenty-fourth aspect of the invention, in the cylinder device of the twenty-third aspect, the second piston may be disposed between the input-side housing and the second pneumatic chamber, may make movement to the other end side due to pressure from the second pneumatic chamber, and may have a rod portion that pressurizes the second hydraulic chamber due to the movement.

According to a twenty-fifth aspect of the invention, in the cylinder device of the twenty-fourth aspect dependent on the twenty-first aspect, the third inlet/outlet may penetrate through the second piston and the rod portion and may penetrate through the second pneumatic chamber and the second hydraulic chamber.

According to a twenty-sixth aspect of the invention, in the cylinder device of the twenty-fourth aspect dependent on the twenty-second aspect, the communicating means may be provided with a communication rod that penetrates through the second piston and the rod portion and is fixed to the second piston, and a valve mechanism disposed on a communication channel between the first pneumatic chamber and the second pneumatic chamber. The valve mechanism may perform opening and closing in association with the movement of the communication rod moving along with the second piston.

According to a twenty-seventh aspect of the invention, there is provided a cylinder device actuating method for actuating the cylinder device according to the twenty-fifth aspect, the method including: a moving step of causing the second piston, the input-side housing, and the output-side housing to move to the other end side by pressurizing the second pneumatic chamber from the first inlet/outlet; a movement stopping step of stopping the movement of the input-side housing and the output-side housing by causing the output rod to abut on a pressing target or causing an output-side end portion of the output-side housing to abut on an end portion of the cylinder on the other side; a fixing step of actuating the fixing means by further pressurizing the second hydraulic chamber from the first inlet/outlet so as to cause the second piston to move to the other end side such that the rod portion pressurizes the second hydraulic chamber and fixing the input-side housing and the output-side housing to the cylinder; and a thrust generating step of actuating the hydraulic pressure amplifying means by pressurizing the first pneumatic chamber from the third inlet/outlet after the fixing, and generating thrust due to the hydraulic pressure amplified from the front end of the output rod.

According to a twenty-eighth aspect of the invention, there is provided a cylinder device actuating method for actuating the cylinder device according to the twenty-sixth, the method including: a moving step of causing the second piston, the input-side housing, and the output-side housing to move to the other end side by pressurizing the second pneumatic chamber from the first inlet/outlet; a movement stopping step of stopping the movement of the input-side housing and the output-side housing by causing the output rod to abut on a pressing target or causing an output-side end portion of the output-side housing to abut on an end portion of the cylinder on the other side; a fixing step of actuating the fixing means by further pressurizing the second hydraulic chamber from the first inlet/outlet so as to cause the second piston to move to the other end side such that the rod portion pressurizes the second hydraulic chamber and fixing the input-side housing and the output-side housing to the cylinder; and a communicating step of opening the valve mechanism and causing the second pneumatic chamber and the first pneumatic chamber to communicate to each other by further pressurizing the second pneumatic chamber from the first inlet/outlet so as to cause the communication rod to move to the other end side along with the second piston after the fixing in the fixing step; and a thrust generating step of actuating the hydraulic pressure amplifying means by further pressurizing the communicated first pneumatic chamber from the third inlet/outlet after the communicating in the communicating step and generating thrust due to the hydraulic pressure amplified from the front end of the output rod.

According to the invention, the movement of the hydraulic chamber in the cylinder by the pneumatic chamber enables both of the stroke and the thrust to be secured.

DETAILED DESCRIPTION OF THE INVENTION

Outline of First Embodiment

Figures 1A, 1B:
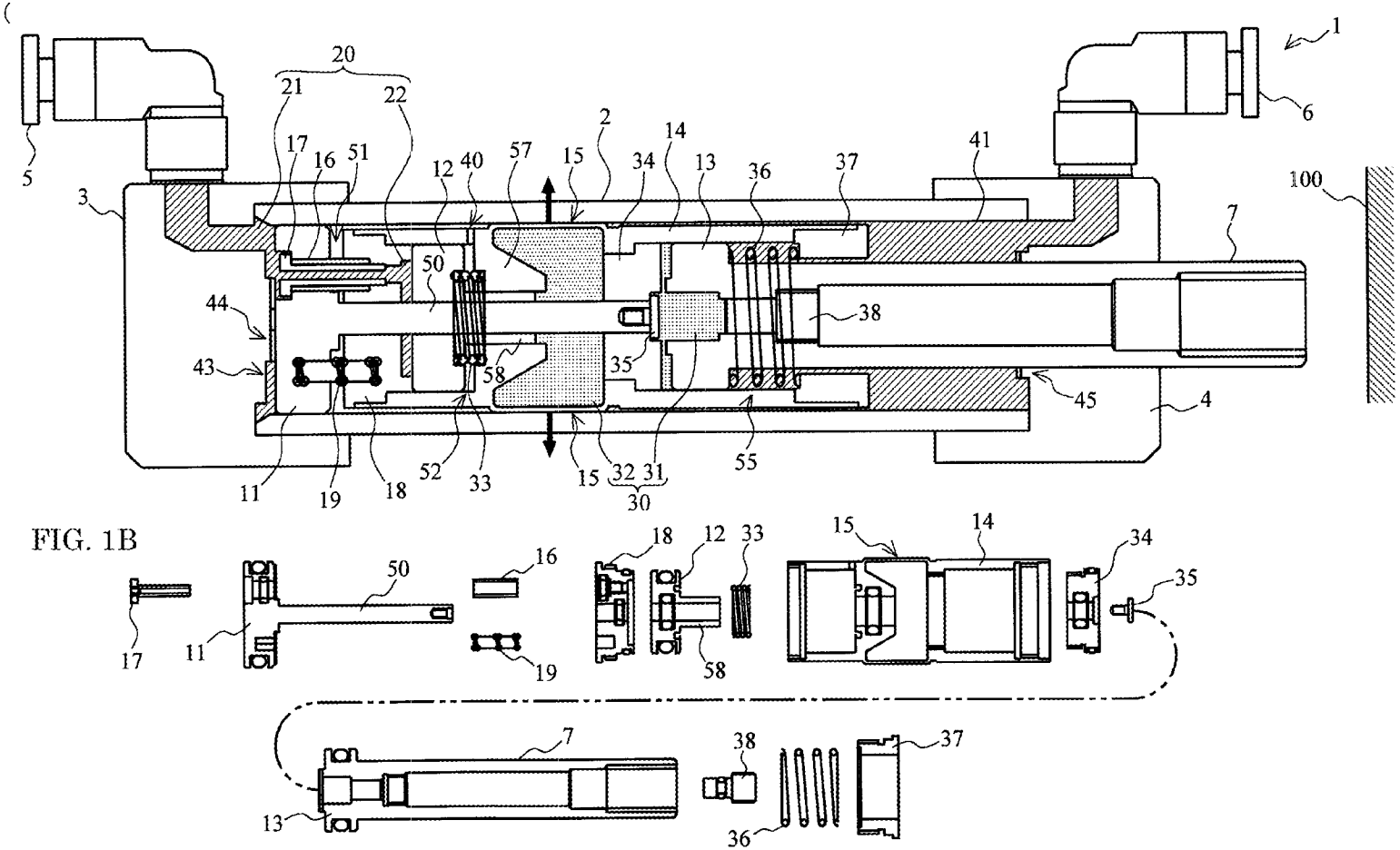
FIGS. 1A and 1B are views for illustrating a cylinder device of a first embodiment.

An air hydraulic cylinder in the related art is characterized in that a long stroke and low thrust are generated in an air cylinder portion and a short stroke and high thrust are generated in a hydraulic cylinder portion.

By comparison, in a cylinder device 1 (FIG. 1A) of the embodiment, a pneumatic system configured of a pneumatic chamber 20 has a function of causing a hydraulic system configured of a hydraulic chamber 30 to move in a thrust direction in a cylinder 2 and a function of generating hydraulic pressure by pressurizing the hydraulic chamber 30 after the moving. In this manner, a necessary stroke is secured and necessary thrust is generated.

More specifically, the pneumatic chamber 20 is configured to include a first pneumatic chamber 21 pressurizing a first piston 11 and a second pneumatic chamber 22 pressurizing a second piston 12.

The first pneumatic chamber 21 and the second pneumatic chamber 22 are in communication with each other through a through-hole formed inside a retaining bolt 17.

On the other hand, a hydraulic pressure generating unit 55 is internally provided with the hydraulic chamber 30, and the hydraulic chamber 30 is configured to have a first hydraulic chamber 31 pressurized by the first pneumatic chamber 21 via the first piston 11 and a second hydraulic chamber 32 pressurized by the second pneumatic chamber 22 via the second piston 12.

The hydraulic pressure generating unit 55 is movable in a thrust direction in the cylinder 2, and the second hydraulic chamber 32 has a function of fixing the moving hydraulic pressure generating unit 55 in the cylinder 2 by causing a thin portion 15 to be elastically deformed in a radial direction due to hydraulic pressure.

The first hydraulic chamber 31 outputs hydraulic pressure of the first hydraulic chamber 31, which is increased by the fixing, to an output rod 7.

Actuation of the cylinder device 1 is as follows.

First, a first inlet/outlet 5 is opened and the air is injected from a second inlet/outlet 6, and the hydraulic pressure generating unit 55 is positioned near the side of the first inlet/outlet 5 and is set in an initial state.

Next, the second inlet/outlet 6 is opened and the air is injected from the first inlet/outlet 5.

In this manner, the first pneumatic chamber 21 is pressurized and the first piston 11 is pushed such that the hydraulic pressure generating unit 55 moves to the side of the second inlet/outlet 6. In this manner, a sufficient stroke of the output rod 7 is achieved.

When the output rod 7 abuts on a workpiece 100, the movement of the hydraulic pressure generating unit 55 is stopped. The second hydraulic chamber 32 inside the hydraulic pressure generating unit 55 has a configuration in which a lid 34 serves as an inner wall thereof on the output side and has a structure in which oil therein is sandwiched between the lid and the second piston 12 of the second pneumatic chamber 22.

Seal members used in the first piston 11 and the second piston 12 are made of different materials and the seal member of the second piston 12 has low sliding resistance such that faster actuation of the second piston is started and the faster actuation is completed. A difference in sliding resistance of the seal members between the first piston 11 and the second piston 12 is based on a difference in friction resistance due to a difference between the materials; however, the difference may be based on a difference in shape or interference.

When the movement of the hydraulic pressure generating unit 55 is stopped and movement of the lid 34 as an internal partition wall is stopped, the second hydraulic chamber is pressed by the second piston 12 from the input side, and thus an internal pressure increases. Simultaneously, the first hydraulic chamber 31 inside the hydraulic pressure generating unit 55 is sandwiched between the output rod 7 and the first piston 11 of the first pneumatic chamber 21. Hence, when the movement is stopped by the output rod 7 on the output side, the first hydraulic chamber is pressed by the first piston 11 from the input side, and thus an internal pressure increases.

At this time, since the second piston 12 having the low sliding resistance moves faster, the thin portion 15 is first elastically deformed due to the hydraulic pressure by the second hydraulic chamber 32 and abuts on an inner circumferential surface of the cylinder 2, and the hydraulic pressure generating unit 55 is fixed to the cylinder 2 due to friction.

When the hydraulic pressure generating unit 55 is fixed thereto, the first piston 11 and the second piston 12 further pressurize the first hydraulic chamber 31 and the second hydraulic chamber 32 with air supplied from the first inlet/outlet 5.

In this manner, the hydraulic pressure increased in the second hydraulic chamber 32 further presses the thin portion 15 to the inner circumferential surface of the cylinder 2, and the fixing is more firmly performed. When the hydraulic pressure generating unit 55 is fixed to the cylinder 2, the thrust that causes a third piston 13 to move forward due to the hydraulic pressure of the first hydraulic chamber 31 is increased. Therefore, the more increased hydraulic pressure of the first hydraulic chamber 31 is output to the output rod 7 via the third piston 13 and large thrust is applied to the workpiece 100 due to the hydraulic pressure.

As described above, the cylinder device 1 achieves both of the long stroke by an air cylinder and high hydraulic pressure by a hydraulic cylinder.

Details of First Embodiment

FIG. 1A is a sectional view in a thrust direction (direction of the centerline) of the cylinder device 1 according to the first embodiment, and FIG. 1B is a view of parts.

In FIG. 1A, an O-ring is omitted for avoiding complicatedness of the figure. The omitted O-ring is disposed between members by which a space is formed and is sealed to contain a fluid such as air or oil. In this manner, the O-ring is provided to seal the space and to prevent leakage of the fluid, and thus, the O-ring is illustrated in the view of parts in FIG. 1B.

The cylinder device 1 is configured to block both opened ends of the cylinder 2 with lids 3 and 4 and accommodates (is internally provided with) the hydraulic pressure generating unit 55 that moves in the thrust direction by the first piston 11 of the first pneumatic chamber 21.

The hydraulic pressure generating unit 55 is an assembly having a hydraulic pressure generating function by being configured to include the second pneumatic chamber 22, the second hydraulic chamber 32, the first hydraulic chamber 31, and the like which are accommodated inside a piston housing 14 as a housing.

The hydraulic pressure generating unit 55 moves to the output side due to the pressure of the first pneumatic chamber 21. The second hydraulic chamber 32 fixes, in the cylinder 2, the hydraulic pressure generating unit 55 moving due to the hydraulic pressure, and the first hydraulic chamber 31 outputs hydraulic pressure increased therein by being fixed, as the thrust in one direction of the output rod 7.

As described above, the cylinder device 1 is provided with a hydraulic chamber that moves to the other end side (output side) due to the pressure of a pneumatic chamber in the cylinder, and the hydraulic chamber is configured to include the first hydraulic chamber 31 in which the output rod 7 is provided and the second hydraulic chamber 32 in which fixing means (the thin portion 15) is provided.

A material of parts that configure the cylinder device 1 is metal such as aluminum, stainless steel, or iron.

As an example of the size of the cylinder device 1, an outer diameter is about 20 mm and a stroke length is about 50 mm; however, the size may be larger or smaller than those described above. As described above, the outline of the configuration of the cylinder device 1 is described.

Hereinafter, the one end side, on which the first inlet/outlet 5 is formed, is referred to as an input side because pressurizing air is input on the side, and the other end side, on which the second inlet/outlet 6 is formed, is referred to as the output side because the hydraulic pressure is output on the side.

In addition, a state illustrated in FIG. 1A in which the parts in the cylinder 2 are positioned on the input-most side is referred to as the initial state.

The cylinder 2 is a circular cylindrical member with both ends opened and configures a housing of the cylinder device 1.

The end portion of the cylinder 2 on the input side is blocked with the lid 3 configured of a circular column-shaped member.

On the output side of the lid 3, a recessed portion 43, into which the cylinder 2 is inserted, is formed, and a male screw formed on the outer circumference of the end portion of the cylinder 2 on the input side is fitted in female threads formed in an inner circumferential surface of the recessed portion 43. In this manner, the cylinder 2 and the lid 3 are screwed and joined to each other.

In a portion of the end portion in the cylinder 2 on the input side, the first piston 11 sliding in the thrust direction along the inner wall of the cylinder 2 is provided.

The end surface of the first piston 11 on the input side is opposite to the bottom surface of the recessed portion 43, and a projecting portion 44 provided with a groove is formed on the bottom surface of the recessed portion 43.

Since the projecting portion 44 restricts a movement range of the first piston 11 to the input side, a space is formed by being surrounded by the recessed portion 43, the end surface of the first piston 11, and the inner wall of the cylinder 2, even in a case where the first piston 11 is positioned near the input-most side.

A side surface of the lid 3 is provided with an inlet/outlet channel that communicates with the space from the first inlet/outlet 5. In this manner, the first pneumatic chamber 21 that can be pressurized and depressurized by intake or exhaust from the first inlet/outlet 5 is formed in the space.

The groove is formed in the projecting portion 44 such that air is rapidly spread all across the end surface of the first piston 11 in a case where the air is supplied from the first inlet/outlet 5.

The end surface of the first piston 11 on the output side is provided with a rod portion 50 that reaches the first hydraulic chamber 31 in the thrust direction by penetrating through a retaining nut 18 to be described below, the second pneumatic chamber 22, the second piston 12, a protruding portion 57, the second hydraulic chamber 32, and the lid 34 along the centerline.

As described above, the first hydraulic chamber 31 is formed on the other end side (output side) of the second hydraulic chamber 32, and the first piston 11 is formed up to the first hydraulic chamber 31 by penetrating through the second pneumatic chamber 22 and the second hydraulic chamber 32.

The first piston 11 has a function of causing the hydraulic pressure generating unit 55 to move to the output side in the cylinder 2 and a function of pressurizing the first hydraulic chamber 31 and outputting the hydraulic pressure to the output rod 7.

The hydraulic pressure generating unit 55 is disposed on the output side of the first piston 11.

The hydraulic pressure generating unit 55 is a hydraulic pressure generating assembly that includes the piston housing 14 having a substantially circular cylinder shape and generates the hydraulic pressure by driving the second pneumatic chamber 22, the second hydraulic chamber 32, and the first hydraulic chamber 31 which are formed in the housing.

The piston housing 14 is a member having a substantially circular cylinder shape with an inner shape in which the second pneumatic chamber 22, the second hydraulic chamber 32, and the first hydraulic chamber 31 are formed from the input side.

At the center of the piston housing 14, the thin portion 15 that slides in the cylinder 2 with a predetermined clearance from the inner circumferential surface of the cylinder 2 is formed on an outer circumferential portion. Opposing end portions of the thin portion 15 are formed to have an outer diameter smaller than that of the thin portion 15.

The retaining nut 18 that blocks an opening of the piston housing 14 is screwed and fixed to the end portion of the piston housing 14 on the input side, by fitting a male screw formed on the retaining nut 18 in female threads formed on the piston housing 14.

A coil spring 19 is provided between the first piston 11 and the retaining nut 18 and biases the first piston and the retaining nut in a direction in which the first piston and the retaining nut are separated from each other.

The coil spring 19 is disposed in a recessed portion formed at a position corresponding to the end surface of the first piston 11 on the output side and the end surface of the retaining nut 18 on the input side.

In addition, the first piston 11 is provided with a through-hole for insertion of the retaining bolt 17, and the retaining nut 18 is provided with a penetrating screw hole for fixing the retaining bolt 17.

A portion of the penetrating screw hole of the retaining nut 18 on the input side is subjected to counterbore machining, and a collar 16 that is a circular cylindrical member is inserted from the through-hole to the portion subjected to the counterbore machining of the first piston 11.

The retaining bolt 17 is inserted into the collar 16, and the front end of the retaining bolt 17 is fitted and screwed in the female threads formed on the retaining nut 18.

In addition, a portion of the through-hole of the first piston 11 on the input side is subjected to the counterbore machining, the head portion of the retaining bolt 17 abuts on the corresponding counterbore portion, and thereby the first piston 11 is prevented from slipping out.

Although not illustrated, an O-ring is provided between the outer circumferential surface of the collar 16 and the inner circumferential surface of the through-hole of the first piston 11 such that the first piston 11 is slidable with respect to the collar 16 in the thrust direction.

As described above, the coil spring 19 biases the first piston 11 in a separating direction from the retaining nut 18, and the retaining bolt 17 restricts the maximum separating distance such that the first piston 11 is not separated from the retaining nut 18 by a distance equal to or longer than a predetermined distance.

The maximum separating distance is set to a distance with which a gap 51 for securing a stroke by which the first piston 11 is pushed to the side of the retaining nut 18 is formed between the end surface of the first piston 11 on the output side and the end surface of the retaining nut 18 on the input side.

With such a configuration described above, in the initial state, the coil spring 19 separates the first piston 11 and the retaining nut 18 from each other by the distance restricted by the retaining bolt 17; however, the first piston 11 is capable of approaching the retaining nut 18 when pressure is applied to the first pneumatic chamber 21 such that the hydraulic pressure generating unit 55 is fixed by the second hydraulic chamber, or the hydraulic pressure generating unit 55 abuts on the lid 4 and cannot move.

At this time, the air in the gap 51 is discharged to the third pneumatic chamber 41 through a space between the outer circumference of the piston housing 14 and the inner circumference of the cylinder 2.

The retaining nut 18 is provided with a recessed portion on the output side, and the second pneumatic chamber 22 is formed by a space formed by the recessed portion and the end surface of the second piston 12 disposed on the output side of the retaining nut 18 in the piston housing 14.

The retaining bolt 17 is provided with a through-hole along the centerline, and the first pneumatic chamber 21 is in communication with the second pneumatic chamber 22 via the through-hole.

As described above, the cylinder device 1 includes the pneumatic chamber (pneumatic chamber 20) formed on the one end side (input side) in the cylinder, and the pneumatic chamber 20 is configured to include the first pneumatic chamber 21 having the first piston 11 that pressurizes the first hydraulic chamber 31 and the second pneumatic chamber 22 having the second piston 12 that pressurizes the second hydraulic chamber 32.

The first pneumatic chamber 21 is formed on the one end side of the second pneumatic chamber 22 and has the first inlet/outlet 5.

Further, the first piston 11 is provided with a communication hole through which the first pneumatic chamber 21 communicates with the second pneumatic chamber 22.

In order to form the second hydraulic chamber 32, the protruding portion 57 protruding from the inner circumferential surface of the cylinder 2 in the centerline direction is formed on the output side of the second piston 12.

A coil spring 33 is disposed between the end surface of the second piston 12 on the output side and the end surface of the protruding portion 57 on the input side and biases the second piston 12 in a separating direction from the protruding portion 57, and the rod portion 50 of the first piston 11 and a rod portion 58 of the second piston 12 are inserted into the center of the coil spring 33.

With such a configuration described above, in the initial state, the end surface of the second piston 12 on the input side abuts on the front end of an edge of the recessed portion of the retaining nut 18, and a gap 52 for securing a stroke by which the second piston 12 is pushed to the side of the protruding portion 57 is formed between the end surface of the second piston 12 on the output side and the end surface of the protruding portion 57 on the input side.

In addition, a portion of the piston housing 14, in which the gap 52 is formed, is provided with a through-hole 40 through which air in the gap 52 escapes to a space between the piston housing 14 and the cylinder 2 when the second piston 12 moves to the side of the protruding portion 57.

The protruding portion 57 has, on the centerline, a through-hole reaching the second hydraulic chamber 32 and the rod portion 58 of the second piston 12 is slidably inserted into the through-hole.

Further, the rod portion 58 has, on the centerline, a through-hole penetrating through the second piston 12 and the rod portion 50 of the first piston 11 is slidably inserted into the through-hole.

As described above, the rod portion 58 is formed to have a circular cylindrical shape, and an end portion of the rod portion, which penetrates through the protruding portion 57 and is exposed to the second hydraulic chamber 32, has a function of a piston that pressurizes oil in the second hydraulic chamber 32.

Here, when P1 represents pressure of the air in the first pneumatic chamber 21 and the second pneumatic chamber 22, S1 represents a sectional area of the second piston 12 in the second pneumatic chamber 22 (an area obtained by projecting a portion receiving the pressure from air, in the thrust direction, the same in the following description), S2 represents a sectional area of the rod portion 58 in the second hydraulic chamber 32, and F1 represents a force by which the coil spring 33 biases the second piston 12, hydraulic pressure P2 of the second hydraulic chamber 32 is obtained in a relationship of $P2=(P1 \cdot S1-F1)/S2$. Therefore, when an expression of $(P1 \cdot S1-F1)/S2>P1$ is satisfied, the pressure of the second pneumatic chamber 22 is amplified and transmitted to the second hydraulic chamber 32.

The hydraulic pressure generating unit 55 is configured to satisfy such a condition, and the second hydraulic chamber 32 firmly fixes the hydraulic pressure generating unit 55 with the amplified hydraulic pressure.

The second hydraulic chamber 32 is configured to have a space, with the input side thereof partitioned by the protruding portion 57, the outer circumferential portion thereof partitioned by the thin portion 15 of the piston housing 14, and the output side thereof partitioned by the lid 34, and is filled with hydraulic oil.

When the second piston 12 is pressed to the side of the protruding portion 57 by the force in the thrust direction, the rod portion 58 is inserted into the second hydraulic chamber 32, and thus the second hydraulic chamber 32 is pressurized in accordance with the expression described above. In particular, when the output rod 7 abuts on the workpiece 100 (more specifically, a tool attached on the front end of the output rod 7 abuts on the workpiece 100), rapid pressurizing is performed.

When the second piston 12 is pressed to the side of the protruding portion 57 by the force in the thrust direction, the rod portion 58 is inserted into the second hydraulic chamber 32, and thus the second hydraulic chamber 32 is pressurized in accordance with the expression described above. At this time, the pressurized pressure uniformly presses the surrounding inner walls. A sectional area of an inner wall of the second hydraulic chamber 32 in the thrust direction is smaller on the input side than on the output side by a sectional area of the rod portion 58, when the sectional areas on the input side and the output side are compared to each other. Therefore, since the force of the oil inside the second hydraulic chamber 32, which presses the inner wall, is larger on the output side on which the sectional area is larger, a force that causes the second hydraulic chamber 32 to move to the output side is applied to the second hydraulic chamber 32.

At this time, since the air is supplied simultaneously to the first pneumatic chamber 21 and the second pneumatic chamber 22, the second piston 12 and the first piston 11 simultaneously start the actuation. Therefore, hydraulic pressure simultaneously starts to be generated also in the first hydraulic chamber 31. Since the hydraulic pressure generated in the first hydraulic chamber 31 presses the end surface of the lid 34 on the output side, a force is generated to cause the hydraulic pressure generating unit 55 to move to the input side.

In a case where the force of causing movement to the output side by the second hydraulic chamber 32 is larger in a relationship between opposite forces of causing movements to the output side and the input side, the force is applied to the hydraulic pressure generating unit 55 in a direction in which the second hydraulic chamber 32 presses the output rod 7; however, since the output rod 7 cannot move, the hydraulic pressure generating unit 55 also stops at the position.

Thus, the hydraulic pressure increased inside the second hydraulic chamber 32 cannot move in the thrust direction because the output rod 7 stops. Thus, pressure is applied to the thin portion 15 having weak stiffness, the thin portion is elastically deformed and expands in the radial direction (outward direction from the centerline) represented by arrow lines, and the outer circumferential surface of the thin portion 15 is pressed to the inner circumferential surface of the cylinder 2. In this manner, the frictional force is generated between the thin portion 15 and the cylinder 2, and the hydraulic pressure generating unit 55 is fixed in the cylinder 2 in the thrust direction.

On the other hand, in a case where the force of causing the movement to the input side by the first hydraulic chamber 31 is larger, the second piston 12 has lower sliding resistance due to the seal member than that of the first piston 11 and is actuated faster. Therefore, the actuation of the second piston 12 is completed before the first piston 11 crosses the gap 51 (before the first piston 11 abuts on the retaining nut 18), the pressure is applied to the thin portion 15 having weak stiffness and the outer circumferential surface of the thin portion is pressed to the inner circumferential surface of the cylinder 2 such that the hydraulic pressure generating unit 55 is fixed in the cylinder 2 in the thrust direction.

As described above, the cylinder device 1 includes fixing means (thin portion 15) for generating a force in the radial direction from the force in the thrust direction that is applied to the hydraulic chamber by the pneumatic chamber and fixing the hydraulic chamber in the cylinder 2 due to the force in the radial direction.

The hydraulic chamber generates the hydraulic pressure by receiving a force in a direction to the other end side (output side) that is applied to the hydraulic chamber by the pneumatic chamber and receiving a force in a direction to the one end side (input side) that is applied to the hydraulic chamber by the output rod.

More specifically, the fixing means generates the force in the radial direction due to the hydraulic pressure of the second hydraulic chamber 32 and fixes the second hydraulic chamber 32 and the first hydraulic chamber 31 by pressing, to the inner wall of the cylinder 2, a side wall of the second hydraulic chamber 32, which is elastically deformed due to the force in the radial direction.

The outer circumferential surface of the lid 34 is provided with the male screw and is fixed by screwing the male screw in the female threads formed on the end portion of the piston housing 14 on the output side.

The lid 34 has, at the center, a through-hole provided with a counterbore portion on the output side, and the front end portion of the rod portion 50 of the first piston 11 is inserted into the through-hole.

A retaining bolt 35 is fixed by being screwed in a screw hole formed in the front end portion of the first piston 11.

The head portion of the retaining bolt 35 abuts on the corresponding counterbore portion formed in the through-hole of the lid 34, and thereby the rod portion 50 is prevented from slipping out.

The third piston 13 provided with the output rod 7 on the output side along the centerline is disposed on the output side of the lid 34, and the first hydraulic chamber 31 is formed by being partitioned by a space formed by the end surface of the lid 34 on the output side, the end surface of the third piston 13 on the input side, the end surface of an oil filler plug 38 on the input side to be described below, and the inner circumferential surface of the piston housing 14.

The center of the end surface of the third piston 13 on the input side is provided with a recessed portion for escaping a case where the rod portion 58 is excessively inserted.

The output rod 7 has a circular cylinder structure including a through-hole on the centerline thereof up to the end portion of the third piston 13 on the input side.

On the input side of the through-hole, the oil filler plug 38 for sealing the first hydraulic chamber 31 after oil supply is fixed by a screw mechanism.

With the configuration, when the first piston 11 approaches the piston housing 14, the rod portion 50 is inserted into the first hydraulic chamber 31 such that the oil in the first hydraulic chamber 31 is pressurized, and the output rod 7 receives the pressurized hydraulic pressure and moves to the output side.

Here, P1 represents pressure of the air in the first pneumatic chamber 21 and the second pneumatic chamber 22, S3 represents a sectional area of the first piston 11 in the first pneumatic chamber 21, P3 represents the hydraulic pressure of the first hydraulic chamber 31, and S4 represents a sectional area of the first piston 11 in the first hydraulic chamber 31.

In this case, a relationship of $P3=S3 \cdot P1/S4$ is satisfied. When an expression of $S3>S4$ is satisfied, the pressure of the first pneumatic chamber 21 is amplified and transmitted to the first hydraulic chamber 31.

As described below, a coil spring 36 performs bias to the input side. However, when F2 represents a force due to the bias, and S5 represents a sectional area of the third piston 13 in the first hydraulic chamber 31, a force F3 with which the output rod 7 presses the workpiece 100 is obtained in an expression of $F3=(P1 \cdot S3 \cdot S5/S4)-F2$.

The hydraulic system (hydraulic chamber 30) of the cylinder device 1 is set such that the pressure of the first pneumatic chamber 21 is amplified in the first hydraulic chamber 31 by the rod portion 50 of the first piston 11 and the force F3 required for processing of the workpiece 100 is exhibited by the output rod 7 (the thrust is increased).

As described above, the cylinder device 1 includes hydraulic pressure amplifying means (the piston 11 or the rod portion 50) that amplifies the hydraulic pressure, which is generated in the first hydraulic chamber 31 by the pneumatic chamber 20, and the output rod 7 that outputs the amplified hydraulic pressure. The hydraulic pressure amplifying means amplifies the hydraulic pressure generated in the first hydraulic chamber 31 and outputs the amplified hydraulic pressure to the output rod 7.

An opened end of the piston housing 14 on the output side is provided with a screw groove, and a retaining nut 37 provided with a through-hole at the center, into which the output rod 7 is inserted, is screwed to the screw groove.

The coil spring 36 is disposed between the end surface of the third piston 13 on the output side and the end surface of the retaining nut 37 on the input side and biases the third piston 13 and the retaining nut 37 in a separating direction from each other, and the output rod 7 is inserted into the center of the coil spring 36.

As described above, the first hydraulic chamber 31 includes an output piston (the third piston) that presses the output rod in an output direction, and the cylinder device 1 includes bias means that biases the output piston in a direction opposite to the output direction.

The coil spring 36 has a function of preventing a position of the output rod 7, which abuts on the workpiece, from being shifted with the output rod 7 moving, before the second hydraulic chamber 32 is pressurized such that the hydraulic pressure generating unit 55 is clamped in the cylinder 2 when the pneumatic chambers 20 (the first pneumatic chamber 21 and the second pneumatic chamber 22) are pressurized.

The coil spring 36 has a function of biasing the third piston 13 and the output rod 7 to the input side (a direction of the lid 34) inside the hydraulic pressure generating unit 55 and a function of preventing motion of the output rod 7 to the output side from occurring due to an external force (for example, disturbance) other than the pressurizing of the pneumatic chamber 20 and the pressurizing of the first hydraulic chamber 31. At this time, the coil spring 36 may cause the third piston 13 (output rod 7) to abut on a part of the lid 34 or the hydraulic pressure generating unit 55 or may cause the third piston to be separated from the lid or the hydraulic pressure generating unit by the oil inside the first hydraulic chamber 31 as illustrated in FIG. 1.

In addition, the coil spring 36 has a function of supporting the motion in a case where the third piston 13 and the output rod 7 retreat to an original position after the output rod 7 performs forward motion due to the pressurizing of the pneumatic chamber 20 and the pressurizing of the first hydraulic chamber 31.

A configuration without the coil spring 36 may be employed. However, the configuration can be employed in a condition that the end surface of the third piston 13 on the output side does not abut on the end surface of the hydraulic pressure generating unit 55 on the input side at all. This state means a state in which the output rod 7 has a very short movement distance and has little motion or a state in which the movement distance is very long and it is not possible to design/manufacture the optimal coil spring.

The lid 4 is a circular cylindrical member and is provided with a recessed portion on the input side thereof, into which the cylinder 2 is inserted.

The inner circumferential surface of the recessed portion is provided with female threads and a male screw formed on a corresponding outer circumferential surface of the cylinder 2 is fitted in the female threads. In this manner, the lid and the cylinder are screwed to each other.

The lid 4 has, on the centerline, a through-hole for insertion of the output rod 7, and the output rod 7 extends to the outside of the lid 4 through the through-hole.

Similar to the projecting portion 44 of the lid 3, a projecting portion 45 provided with a groove on the front end thereof is formed on the bottom surface of the recessed portion of the lid 4. When the piston housing 14 (the hydraulic pressure generating unit 55) moves in the output direction, the retaining nut 37 abuts on the projecting portion 45 of the lid 4. The groove on the front end of the projecting portion 45 is formed such that air supplied from the second inlet/outlet 6 in an abutting state is rapidly spread all across the end surface of the third piston 13 by passing between the retaining nut 37 and the output rod 7.

Further, a side surface of the lid 4 is provided with an inlet/outlet channel that communicates with the inside of the cylinder 2 from the second inlet/outlet 6, and the third pneumatic chamber 41, which performs intake or exhaust from the second inlet/outlet 6, is formed on the output side in the cylinder 2.

The first inlet/outlet 5 is opened and the air is supplied from the second inlet/outlet 6, and thereby the third pneumatic chamber 41 causes the hydraulic pressure generating unit 55 to move to the input side and is used to cause the cylinder device 1 to return to the initial state.

As described above, the cylinder device 1 includes the third pneumatic chamber 41 that is provided on the other end side in the cylinder, has the second inlet/outlet 6, and presses the hydraulic chamber (hydraulic chamber 30) to the one end side.

As described above, the cylinder device 1 configured as described above is actuated as follows.

First, while the first inlet/outlet 5 is opened and the pneumatic chambers 20 (the first pneumatic chamber 21 and the second pneumatic chamber 22) are depressurized, air is supplied from the second inlet/outlet 6 such that the pneumatic chambers 20 and the hydraulic chambers 30 (first hydraulic chamber 31 and the second hydraulic chamber 32) are set to the initial state.

Next, while the second inlet/outlet 6 is opened and the third pneumatic chambers 41 are depressurized, air is supplied from the first inlet/outlet 5.

The pressure of the first pneumatic chamber 21 and the second pneumatic chamber 22 is increased and the first piston 11 presses the hydraulic pressure generating unit 55. In this manner, the hydraulic pressure generating unit 55 slides and moves to the output side until the output rod 7 abuts on the workpiece 100.

As described above, the first piston causes the second pneumatic chamber 22, the first hydraulic chamber 31, and the second hydraulic chamber 32 to move to the other end side (output side) until the output rod 7 abuts on the pressing target (workpiece 100) due to the pressure of the first pneumatic chamber 21.

When the hydraulic pressure generating unit 55 moves and the front end of the output rod 7 (more specifically, the front end of the tool attached to the output rod 7) abuts on the workpiece 100, the first piston 11 pressurizes the first hydraulic chamber 31 and the second piston 12 pressurizes the second hydraulic chamber 32. Therefore, the oils in the first hydraulic chamber 31 and the second hydraulic chamber 32 are pressurized to increase these hydraulic pressures.

In the hydraulic pressure generating unit 55, the sectional area on the output side is larger than the sectional area on the input side by the sectional area of the rod portion 58, of the sectional area of the inner wall of the second hydraulic chamber 32 in the thrust direction, and thus pressing force is generated by a difference between the sectional areas in the direction of the output rod 7.

At this time, since the hydraulic pressure generated in the first hydraulic chamber 31 presses the end surface of the lid 34 on the output side, the force is generated to cause the hydraulic pressure generating unit 55 to move to the input side.

In the case where the force of causing movement to the output side by the second hydraulic chamber 32 is larger in the relationship between opposite forces of causing the movements to the output side and the input side, the output rod 7 abuts on the workpiece so as to be stopped. Thus, the hydraulic pressure generating unit 55 also stops at the position.

In this manner, since the oil inside the second hydraulic chamber 32 cannot move in the thrust direction, the internal pressure is further increased and the thin portion 15 is pressed and elastically deformed, in the radial direction, thereby abutting the thin portion on the inner circumferential surface of the cylinder 2. In this manner, the hydraulic pressure generating unit 55 is fixed in the cylinder 2.

On the other hand, in a case where the force of causing the movement to the input side by the first hydraulic chamber 31 is larger, the second piston 12 has lower sliding resistance than that of the first piston 11 and is actuated faster. Therefore, the actuation of the second piston 12 is completed before the first piston 11 crosses the gap 51, the pressure is applied to the thin portion 15 having the weak stiffness, and the outer circumferential surface of the thin portion is pressed to the inner circumferential surface of the cylinder 2 such that the hydraulic pressure generating unit 55 is fixed in the cylinder 2 in the thrust direction.

In a state in which the hydraulic pressure generating unit 55 is fixed, the hydraulic pressure of the first hydraulic chamber 31 and the second hydraulic chamber 32 is further increased because the air is further supplied to the pneumatic chamber 20. In this manner, the thin portion 15 further presses the cylinder 2 and a grip force by the pressing force of the thin portion 15 is increased. The grip force by the thin portion 15 is increased, and thereby the hydraulic pressure generating unit 55 is firmly held in the thrust direction (fixing of the hydraulic pressure generating unit 55 to cylinder 2 with the thin portion 15). Motion is not performed even when a force in the thrust direction, in which the hydraulic pressure of the first hydraulic chamber 31 is generated, is received. The hydraulic pressure of the first hydraulic chamber 31 is applied to the output rod 7 and the workpiece 100 is pressed due to the hydraulic pressure against the bias force of the coil spring 36.

At this time, in a case where the output rod 7 abuts on the workpiece 100, and then there is no movement, deformation, or the like due to the hydraulic pressure applied from the output rod 7 only by pressing or fixing the workpiece 100 at the position, the third piston 13 does not move in the thrust direction inside the first hydraulic chamber 31, and thus the oil in the first hydraulic chamber 31 is not taken out to the outside along with movement of the O-ring of the third piston 13 (refer to FIG. 1B).

In addition, the second hydraulic chamber 32 is sealed to contain the oil inside and has a constant volume. Therefore, when the thin portion 15 expands in the radial direction, a volume in the thrust direction is reduced and shortened by an increase in volume in the radial direction, and the second piston 12 can move forward by the shortened amount of the volume. The thin portion 15 has a very small amount of deformation in the radial direction and has a small amount of deformation in the thrust direction depending on the deformation in the radial direction, and thus the second piston 12 also has a small distance of movement and little moves. Therefore, the oil in the second hydraulic chamber 32 is not taken out to the outside by moving the O-ring (refer to FIG. 1B) of the second piston 12. In the embodiment, the movement distance of the second piston 12 is set to a distance within a range of the elastic deformation of a seal member such as the O-ring (the seal member of the second hydraulic chamber 32 disposed on the second piston 12). In the embodiment, the O-ring does not move at all, and thus the internal oil is not taken out to the outside.

When a pressing process against the workpiece 100 is ended, the first inlet/outlet 5 is opened, and the first pneumatic chamber 21 and the second pneumatic chamber 22 are depressurized.

In this manner, the hydraulic pressure of the first hydraulic chamber 31 and the second hydraulic chamber 32 is reduced.

The third piston 13 returns to a position of the initial state due to the bias force of the coil spring 36 in the first hydraulic chamber 31, and the elastic deformation of the thin portion 15 is restored due to the restoring force in the second hydraulic chamber 32. In this manner, the fixing of the hydraulic pressure generating unit 55 is canceled. In addition, the second piston 12 returns to a position of the initial state due to the bias force of the coil spring 33.

Next, an example, in which the workpiece 100 is pressed and clamped by using the cylinder device 1, will be described.

The optimal clamping member is to be attached to the front end of the output rod 7 in order to press and clamp the workpiece 100 in the cylinder device 1.

The cylinder device 1 performs clamping actuation of a member that presses and clamps the workpiece 100 in the following order.

(1) First, the first inlet/outlet 5 is opened and the air is supplied to the second inlet/outlet 6, and thereby the cylinder device 1 comes into the initial state. In this manner, the clamping member retreats, and the workpiece 100 is mounted at a predetermined position. At this time, the workpiece 100 is mounted not to move even when being pressed.

(2) The second inlet/outlet 6 is opened and the air is supplied from the first inlet/outlet 5. The output rod 7 moves forward in the output direction by air drive, and the clamping member attached on the front end of the output rod 7 abuts on the workpiece 100.

(3) When the clamping member abuts on the workpiece, the pressure of the pneumatic chamber 20 is increased and the hydraulic pressure generating unit 55 is fixed to the cylinder 2. The thrust is generated in the output rod 7 due to the hydraulic pressure. In this manner, the workpiece 100 is strongly forced to be clamped to a member that clamps the workpiece 100, in order to press the workpiece 100 with a strong force.

(4) In a case where the workpiece 100 is released from the clamping member, the first inlet/outlet 5 is opened and the air is supplied from the second inlet/outlet 6. The output rod 7 retreats by the air drive, and then the workpiece 100 is detached from a predetermined position.

Hereinafter, while the workpiece 100 is replaced, the cycle described above is repeatedly performed.

Here, a case of generating hydraulic pressure in a cylinder end, that is, generating the hydraulic pressure in a state in which the hydraulic pressure generating unit 55 abuts on the cylinder end (lid 4) on the output side is described. In this example of the actuation, it is possible to generate hydraulic thrust even when the output rod 7 does not abut on the workpiece 100 in some cases.

Hereinafter, the actuation will be described.

When the hydraulic pressure generating unit 55 moves forward and abuts on the cylinder end (lid 4), the second piston presses the second hydraulic chamber 32 by the second pneumatic chamber 22 and the first piston simultaneously presses the first hydraulic chamber 31 by the first pneumatic chamber 21. Since the hydraulic pressure generating unit 55 cannot move forward, the oil inside the second hydraulic chamber 32 is constricted and pressurized by the lid 34 and the second piston 12. The thin portion 15 is elastically deformed and fixes the inner wall of the cylinder 2. At this time, since the sliding resistance of the second piston 12 is lower than that of the first piston 11, the second piston is actuated faster, and the actuation of the second piston 12 is completed before the first piston 11 crosses the gap 51.

When the hydraulic pressure generating unit 55 is fixed to the cylinder 2, the grip force in the thrust direction is increased and the stiffness is increased. Thus, the hydraulic thrust that is generated in the first hydraulic chamber 31 in the thrust direction can be received, and the hydraulic thrust is generated in the output rod 7.

In this manner, even in a state in which the output rod 7 does not abut on the workpiece, it is possible to apply the hydraulic thrust to the output rod 7.

Figure 2A:
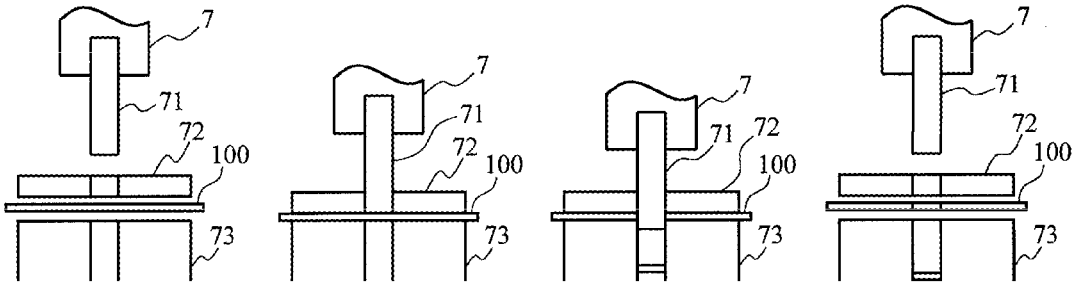
FIGS. 2AA to 2BD are views for illustrating press working.

FIG. 2AA to 2AD are views illustrating an example in which press working (punching) is performed by using the cylinder device 1.

The press machine not illustrated fixes the cylinder device 1 with the output direction as a downward direction.

The punch 71 that is a tool for a punching die is fixed on the front end of the output rod 7 so as to be coaxial to the output rod 7, and a mounting stand 73, the workpiece 100, and a jig 72 are disposed in this order from below on the lower side thereof. The mounting stand 73, the workpiece 100, and the jig 72 function as workpiece mounting means.

The punch 71 has a circular column shape and is a die that drills a circular hole in the workpiece 100 formed of a metal sheet.

During the punching, the jig 72 is a member that presses the workpiece 100 to the mounting stand 73 and fixes the workpiece 100 and is provided with a through-hole through which the punch 71 passes.

The mounting stand 73 is also provided with a through-hole to which the punch 71 escapes during the punching.

In the configuration described above, the cylinder device 1 performs the press working in the following order.

(1) First, the first inlet/outlet 5 is opened and the air is supplied to the second inlet/outlet 6, and thereby the cylinder device 1 is in the initial state. In this manner, the punch 71 retreats, and the workpiece 100 and the jig 72 are mounted at predetermined positions on the mounting stand 73.

(2) Next, the workpiece 100 is pressed and fixed to the mounting stand 73 by the jig 72. The second inlet/outlet 6 is opened and the air is supplied from the first inlet/outlet 5.

The output rod 7 moves forward in the output direction by air drive, and the front end of the punch 71 abuts on the workpiece 100.

(3) When the front end of the punch 71 abuts on the workpiece, the pressure of the pneumatic chamber 20 is increased, the hydraulic pressure generating unit 55 is fixed to the cylinder 2, and the output rod 7 is driven due to the hydraulic pressure. In this manner, the punch 71 is pressed to the workpiece 100 with a strong force, and the workpiece 100 is punched. As described above, the press machine includes press means.

(4) When a hole is formed in the workpiece 100, the first inlet/outlet 5 is opened and the air is supplied from the second inlet/outlet 6. The punch 71 is pulled up by the air drive, and then the workpiece 100 is detached from the predetermined position. As described above, the press machine includes detachment means.

Figure 2B:
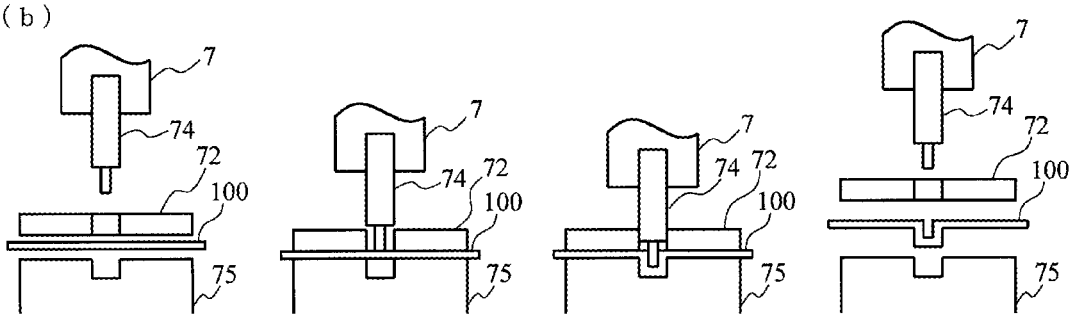

FIG. 2BA to 2BD are views illustrating an example in which a recessed portion is formed in the workpiece 100 by the press working by using the cylinder device 1.

A male die 74 is a male die having a circular column shape, has the front end provided with a protrusion for forming the recessed portion, and is coaxially attached to the output rod 7.

A female die 75 is a female die and has a recessed portion formed to receive the protrusion of the male die 74.

In the configuration described above, the cylinder device 1 performs the press working in the following order.

(1) First, the first inlet/outlet 5 is opened and the air is supplied to the second inlet/outlet 6, and thereby the cylinder device 1 is in the initial state. In this manner, the male die 74 retreats, and the workpiece 100 and the jig 72 are mounted on the female die 75.

(2) Next, the workpiece 100 is pressed and fixed to the female die 75 by the jig 72. The second inlet/outlet 6 is opened and the air is supplied from the first inlet/outlet 5. The output rod 7 moves forward in the output direction by the air drive, and the front end of the male die 74 abuts on the workpiece 100.

(3) When the front end of the male die 74 abuts on the workpiece, the pressure of the pneumatic chamber 20 is increased, the hydraulic pressure generating unit 55 is fixed to the cylinder 2, and the output rod 7 is driven due to the hydraulic pressure. In this manner, the male die 74 is pressed to the workpiece 100 with a strong force, and the recessed portion is formed in the workpiece 100.

(4) When the recessed portion is formed in the workpiece 100, the first inlet/outlet 5 is opened and the air is supplied from the second inlet/outlet 6. The male die 74 is pulled up by the air drive.

Second Embodiment

A cylinder device 1*a* according to the embodiment includes an output rod 77 also on the input side.

Hereinafter, the description of the same parts as the first embodiment will be simplified or omitted, and differences will be described.

Figure 3:
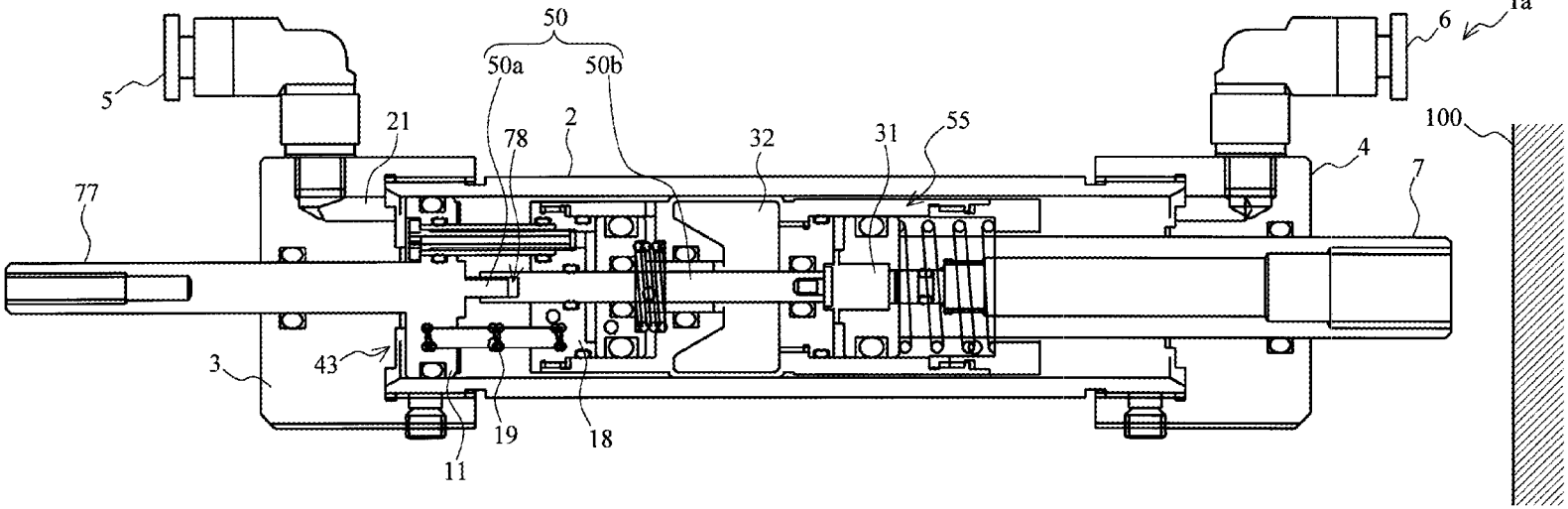
FIG. 3 is a view for illustrating a cylinder device of a second embodiment.

FIG. 3 illustrates a sectional view of the cylinder device 1*a* in the thrust direction.

A through-hole is formed at the center of the recessed portion 43 of the lid 3.

The end surface of the first piston 11 on the input side has the output rod 77 that is inserted into the through-hole and extends to the outside of the cylinder device 1, on the centerline of the first piston 11.

As described above, the cylinder device 1*a* includes a pneumatic rod (output rod 77) formed from the first piston to the one end side of the cylinder by penetrating through the first pneumatic chamber 21.

In addition, the rod portion 50 formed on the output side of the first piston 11 is divided into a rod portion 50*a* provided on the first piston 11 and a rod portion 50*b* that pressurizes the first hydraulic chamber 31. The end portion of the rod portion 50*a* on the output side is inserted into the recessed portion formed on the end portion of the rod portion 50*b* on the input side.

A gap 78 is provided between the front end of the rod portion 50*a* and the bottom surface of the recessed portion of the rod portion 50*b*, in the corresponding insertion portion.

As described above, the gap 78 that divides the rod portion 50 is provided to avoid generating the hydraulic pressure in the first hydraulic chamber 31 by the first piston 11 at the moment when the output rod 7 abuts on the workpiece 100 as follows.

When the first piston 11 transfers the hydraulic pressure generating unit 55 to the output side, the air supplied to the pneumatic chamber 22 presses the second piston 12 and the second piston 12 presses the second hydraulic chamber 32 such that the movement is performed. At this time, since a reaction force of the movement to the output side does not act on the hydraulic pressure generating unit 55, the oil of the second hydraulic chamber 32 is not confined and the thin portion 15 is not elastically deformed. In addition, the coil spring 19 biases the first piston 11 and the retaining nut 18 in a separating direction from each other, and thus the hydraulic pressure generating unit 55 moves as the gap 78 is maintained.

When the output rod 7 abuts on the workpiece 100, the hydraulic pressure generating unit 55 clamps the cylinder 2 by the second hydraulic chamber 32.

During the abutting, since the first hydraulic chamber 31 is not pressurized due to the presence of the gap 78, the output rod 7 abuts on the workpiece 100 without generating the hydraulic pressure.

Next, when the first piston 11 moves to the output side by the distance of the gap 78 and the rod portion 50*a* comes into contact with the rod portion 50*b*, the hydraulic pressure is generated in the first hydraulic chamber 31 and the output rod 7 is driven by the corresponding hydraulic pressure.

As described above, a method of dividing the rod portion 50 is effective in a case where the fixing of the hydraulic pressure generating unit 55 to the cylinder 2 is reliably actuated faster than the generation of the hydraulic thrust of the output rod 7 and the hydraulic pressure is not applied to the workpiece 100 at the moment of abutting of the output rod 7.

In the cylinder device 1*a* configured as described above, when the air is supplied to the first inlet/outlet 5 from the initial state, the output rod 77 and the output rod 7 move along with the first piston 11 in the output direction. When the output rod 7 abuts on the workpiece 100, first, fixing of the hydraulic pressure generating unit 55 is achieved, and then the hydraulic pressure is generated in the output rod 7.

As described above, in the second embodiment, it is possible to drive the output rod 7 with air and the hydraulic pressure and to drive the output rod 77 with air. For example, the output rod 77 can be used to detect a position at which the first piston 11 is actuated by providing a sensor not illustrated on the outside of the cylinder device 1*a* and providing a dog to the output rod 77, which can be sensed by the sensor.

Figure 4A:
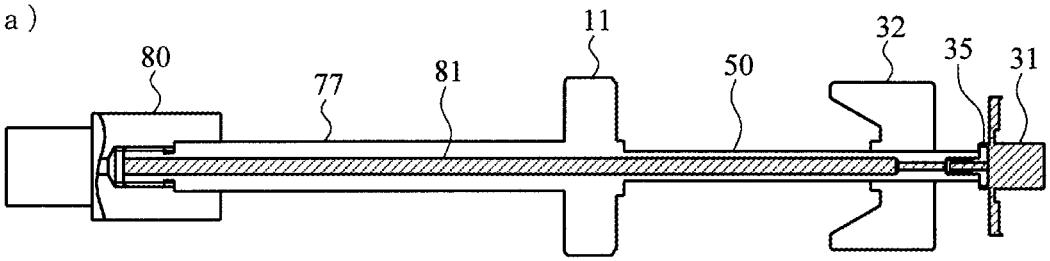
FIGS. 4A to 4C are views for illustrating a modification example of the second embodiment.
Figure 4B:
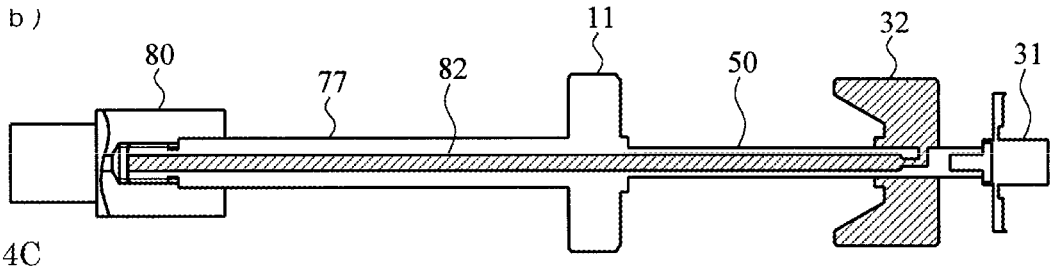
Figure 4C:
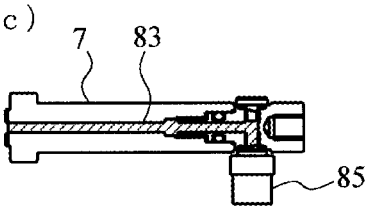

FIGS. 4A to 4C are views for illustrating a modification example of the second embodiment described in FIG. 3.

In the modification example, the pressure of the first hydraulic chamber 31 or the second hydraulic chamber 32 can be measured. In FIGS. 4A to 4C, only necessary portions are illustrated by being pulled out from the cylinder device 1*a*.

In the example of FIG. 4A, a through-hole 81 is formed from the first hydraulic chamber 31 by penetrating through the retaining bolt 35, the rod portion 50, and the output rod 77, and a pressure sensor 80 is disposed on the front end of the output rod 77.

The first hydraulic chamber 31 and the through-hole 81 are filled with oil and the hydraulic pressure of the first hydraulic chamber 31 is detected by the pressure sensor 80.

The rod portion 50 of the second embodiment is divided into two of the rod portion 50*a* and the rod portion 50*b* with a gap 78 therebetween as illustrated in FIG. 3; however, the rod portion 50 of the modification example is integrally formed as illustrated in FIGS. 4A to 4C.

In the example of FIG. 4B, an opening is provided in a side surface of the rod portion 50 in the second hydraulic chamber 32, a through-hole 82 is formed from the opening by penetrating through the rod portion 50 and the output rod 77, and the pressure sensor 80 is disposed on the front end of the output rod 77.

The second hydraulic chamber 32 and the through-hole 82 are filled with oil and the hydraulic pressure of the second hydraulic chamber 32 is detected by the pressure sensor 80.

In the example of FIG. 4C, an opening is provided in a side surface up to the front end in a portion of the output rod 7, which projects from the cylinder device 1 to the outside, a through-hole 83 is formed from the opening by penetrating through the center of the output rod 7 to reach the first hydraulic chamber 31, and a hydraulic pressure sensor 85 is disposed in the opening.

The first hydraulic chamber 31 and the through-hole 83 are filled with oil and the hydraulic pressure of the first hydraulic chamber 31 is detected by the hydraulic pressure sensor 85.

When the pressure sensor 80 in FIG. 4B is combined with the hydraulic pressure sensor 85 in FIG. 4C, it is possible to measure the hydraulic pressure of both of the second hydraulic chamber 32 and the first hydraulic chamber 31.

Third Embodiment

In a cylinder device 1*b* according to the embodiment, the hydraulic pressure generating unit 55 is fixed to the cylinder 2 by a clamper.

Figures 5A, 5B, 5C, 5D:
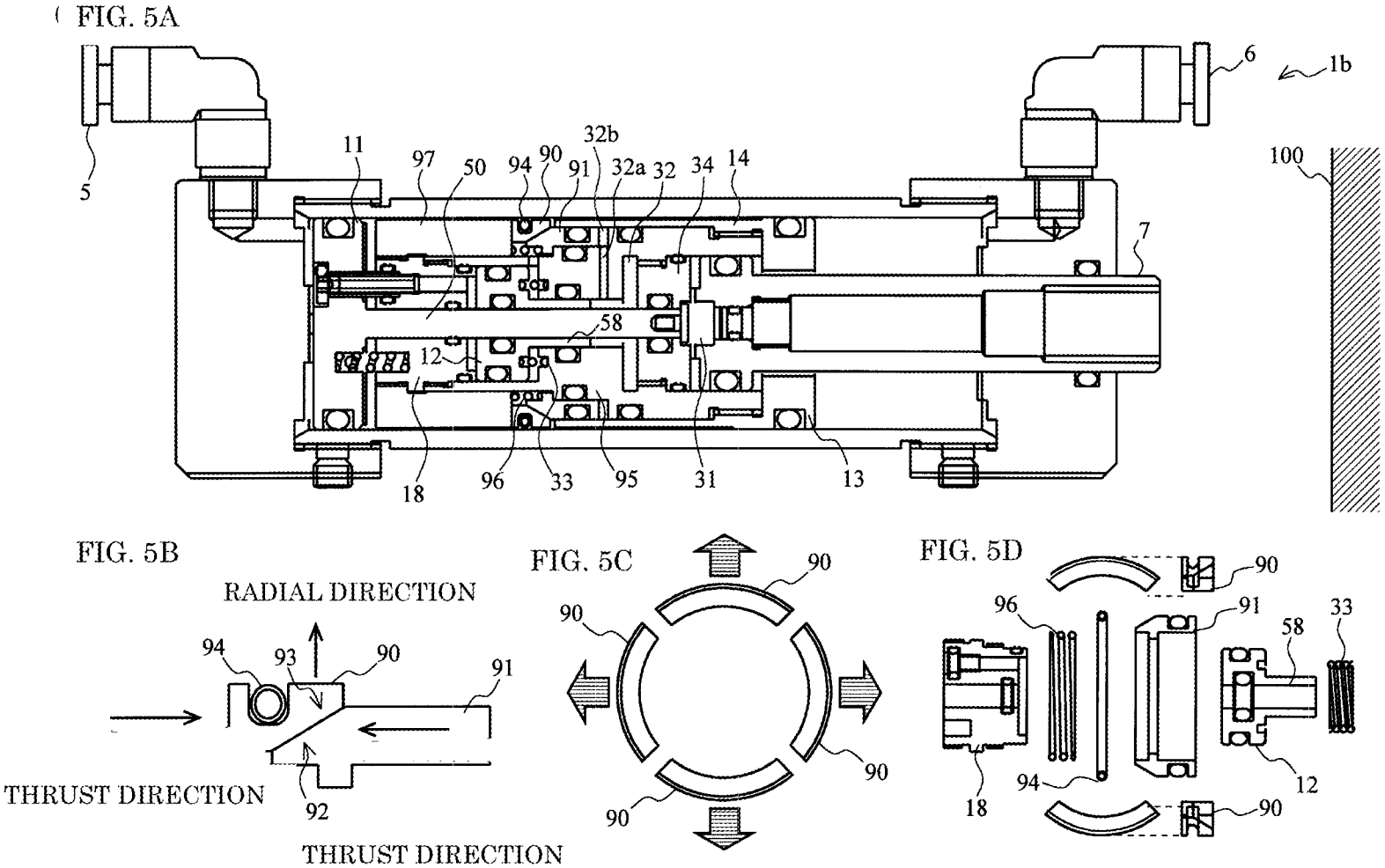
FIGS. 5A to 5D are views for illustrating a cylinder device of a third embodiment.

FIG. 5A illustrates a sectional view of the cylinder device 1*b* around a clamper 90 in the thrust direction, and FIG. 5D illustrates a view of parts around the clamper 90.

The end surface of the second hydraulic chamber 32 on the input side is configured to have an end surface of a circular column member 95 fixed to the piston housing 14 and an end surface of an annular member 91 provided around the circular column member 95.

The annular member 91 has an inner circumferential surface being in contact with an outer circumferential surface of the circular column member 95 and an outer circumferential surface being in contact with an inner circumferential surface of the piston housing 14. Such a contact surface is sealed by an O-ring, and the annular member 91 having airtightness as it is can move in the thrust direction.

The circular column member 95 is provided with female threads on the input side thereof and a member corresponding to the retaining nut 18 in the first embodiment is attached to the female threads. A male screw is formed on the input side of the member corresponding to the retaining nut 18, and a nut 97 is screwed and fixed thereto.

A coil spring 96 is disposed between the end surface of the nut 97 on the output side and the annular member 91. While the annular member 91 secures a space that configures the second hydraulic chamber 32 (although not illustrated, restriction means for restricting movement of the annular member 91 to the output side is provided in order to secure the space), and the coil spring 96 causes the bias on the output side.

Therefore, the annular member 91 moves to the input side when the hydraulic pressure of the second hydraulic chamber 32 is increased, and the annular member 91 moves to the output side and returns to the original position when the hydraulic pressure is reduced.

As illustrated in FIG. 5B, a taper portion 92 is formed on the end portion of the annular member 91 on the input side, and an outer diameter of the taper portion is reduced as a portion approaches the input side (left side in the Figure).

The clamper 90 functioning as the fixing means is disposed in a space formed between the taper portion 92 and the end surface of the nut 97 on the output side of the annular member 91.

The clamper 90 is an annular member in which a taper portion 93, of which an inner diameter is reduced as a portion approaches the input side, is formed and an angle of the taper portion 93 is equal to an angle of the taper portion 92.

The clamper 90 illustrated in FIG. 5C is divided into four parts so as to be widened in the radial direction represented by arrow lines.

An outer circumferential surface of the clamper 90 is formed to be parallel to the inner circumferential surface of the cylinder 2, and a predetermined clearance is formed between the outer circumferential surface of the clamper 90 and the inner circumferential surface of the cylinder 2 in the initial state such that the frictional force is not generated between the two surfaces.

Further, the outer circumferential surface of the clamper 90 is provided with a groove in a circumferential direction, and the O-ring 94 is disposed in the groove.

In general, the O-ring is disposed to maintain the airtightness; however, the O-ring 94 is disposed to cause the clamper 90 widened in the radial direction to return to the original state.

Therefore, the height of the groove formed in the outer circumferential surface of the clamper 90 is set to a size larger than the diameter of the O-ring 94, and thus the O-ring 94 is provided not to be in contact with the inner circumferential surface of the cylinder 2.

In the embodiment, the O-ring 94 is used; however, in a case where the clamper is widened in the radial direction and the inner diameter is increased, any member may be used as long as the member contracts the widened size to the original inner diameter and causes the clamper to return to the original state. For example, a ring-shaped elastic member having a string shape with elasticity may be used. In addition, a member having an annular shape by joining both ends of the coil spring may be used.

In the cylinder device 1*b* configured as described above, in the initial state, the pressure of the second hydraulic chamber 32 is low, and thus the coil spring 96 biases the annular member 91 to the output side. In this manner, a sufficient clearance is secured between the end surface of the nut 97 on the output side and the taper portion 92 of the annular member 91.

Therefore, the clamper 90 is bundled up by contractile force of the O-ring 94 in the central axis direction, and thus a clearance is formed between the clamper 90 and the inner circumferential surface of the cylinder 2 such that the hydraulic pressure generating unit 55 is movable in the thrust direction.

On the other hand, when the pressure of the second hydraulic chamber 32 is increased, the clamper 90 is pushed and moves in the direction to the input side due to the hydraulic pressure.

The clamper 90 is sandwiched between the end surface of the nut 97 on the output side and the taper portion 92 of the annular member 91 and receives a force in the thrust direction from both end sides as illustrated by an arrow line in FIG. 5B.

To be specifically described, when the second piston 12 moves forward, the pressure of the second hydraulic chamber 32 is increased, and the increase in pressure reaches a hydraulic chamber 32*b* (second hydraulic chamber) of a space of the end surface of the annular member 91 through a communication channel 32*a*.

The annular member 91 moves to the input side while the clamper 90 is widened, when a force, with which the O-ring 94 contracts the clamper 90, is smaller than a force that is generated due to the pressure of the second hydraulic chamber 32 and causes movement in the thrust direction. At this time, the oil inside the second hydraulic chamber 32, which is pushed by the second piston 12, flows into the space of the end surface through the communication channel 32*a* and thus the annular member 91 moves in the thrust direction.

The force in the thrust direction is converted into a force in the radial direction as illustrated by an arrow line in FIG. 5B, by abutting of the taper portion 92 of the annular member 91 and the taper portion 93 of the clamper 90. As a result, the clamper 90 is pushed in the radial direction.

In this manner, the outer circumferential surface of the clamper 90 abuts on the inner circumferential surface of the cylinder 2, the frictional force is generated therebetween, and the hydraulic pressure generating unit 55 is fixed in the cylinder 2.

A fixing method by the clamper 90 used in the third embodiment can be used in the first embodiment, the second embodiment, and a fourth embodiment to be described below.

In this example, the force in the radial direction is generated by pressing, to the clamper 90, the taper member (annular member 91) moving in the thrust direction, due to the hydraulic pressure generated in the second hydraulic chamber 32, and the second hydraulic chamber 32 and the first hydraulic chamber 31 are fixed by pressing the clamper 90 to the inner wall of the cylinder by the force.

Fourth Embodiment

A cylinder device 1*c* according to the embodiment is a device obtained by combining the divided rod method of the cylinder device 1*a* with the cylinder device 1.

Figure 6:
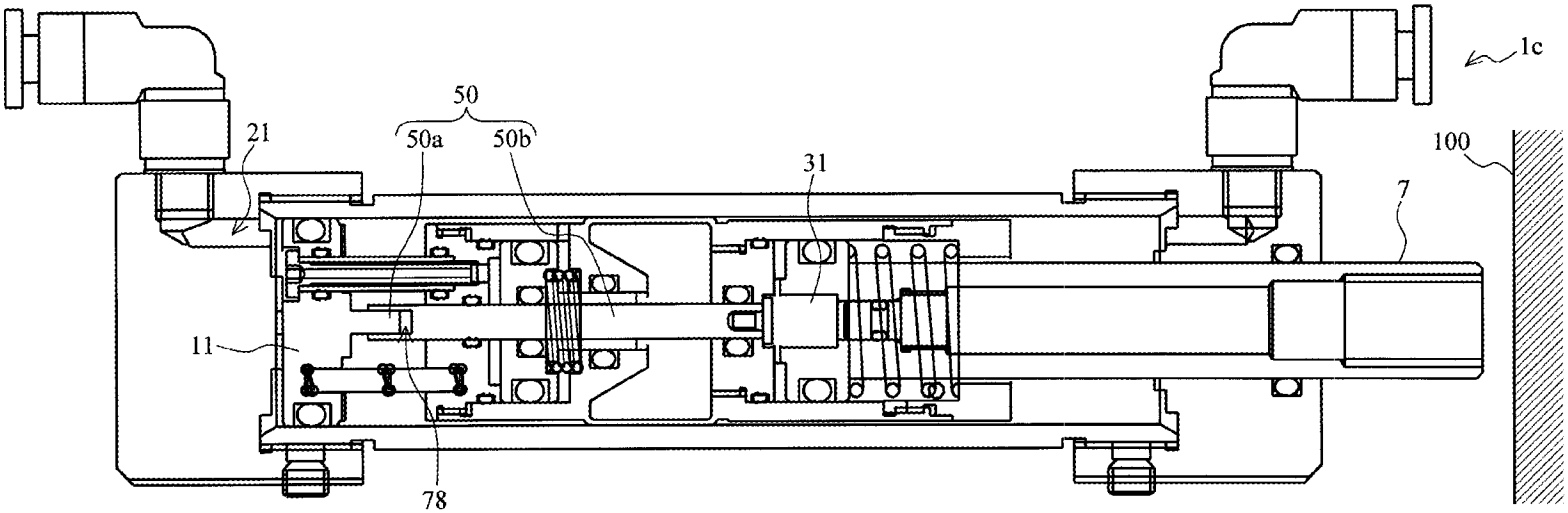
FIG. 6 is a view for illustrating a cylinder device of a fourth embodiment.

As illustrated in FIG. 6, the cylinder device 1*c* is obtained by dividing the rod portion (shaft portion) 50 in the cylinder device 1 into the rod portion 50*a* and the rod portion 50*b* and providing the gap 78 therebetween.

As described in the second embodiment, when the corresponding configuration is employed, the pressure of the first pneumatic chamber 21 is increased, and thus the hydraulic pressure generating unit 55 moves by the first piston 11. At the moment when the output rod 7 abuts on the workpiece 100, it is possible to prevent the output rod 7 from outputting the hydraulic pressure to the workpiece 100 at the moment of abutting, without generating the hydraulic pressure in the first hydraulic chamber 31.

As described above, in the cylinder device 1*c*, the rod portion 50 of the first piston is divided into two rod portions 50*a* and 50*b* provided with the predetermined clearance therebetween.

According to the embodiments described above, it is possible to obtain the following effects.

(1) By skillfully combining an air piston and a hydraulic piston and internally providing an air hydraulic mechanism, the piston can be actuated as the air piston until the piston abuts on the workpiece 100 and can be actuated as the hydraulic cylinder after the piston abuts on the workpiece 100, and thus it is possible to realize both of the movement of the long stroke by the air piston and the large thrust as the characteristic of the hydraulic piston, with only air supply for which there is no need to provide individual ancillary equipment such as a hydraulic pump or hydraulic piping or the like requiring labor for construction.

(2) After the stroke required by the air piston is obtained, the force in the thrust direction is converted into the force in the radial direction by the elastic deformation of the thin portion 15, pushing of the clamper 90, or the like, such that it is possible to fix the hydraulic piston in the cylinder 2.

(3) The force in the radial direction is increased due to the hydraulic pressure such that it is possible to fix the hydraulic piston, and thus the hydraulic piston can be firmly fixed.

(4) It is possible to generate a large force by generating the hydraulic pressure in the hydraulic cylinder fixed in the cylinder 2.

(5) Since the necessary stroke is almost obtained by the air piston and the requisite minimum stroke is obtained by the hydraulic piston, it is possible to decrease a length of the stroke of the hydraulic piston, and thus it is possible to minimize wear due to oil leakage.

In particular, in a case of a using method in which the output rod 7 abuts on the workpiece 100, and only the hydraulic pressure is applied to the workpiece without movement of the output rod 7 after the abutting, the movement distances of the hydraulic pistons in the hydraulic chambers are all within the range of the elastic deformation of the seal member, and thus it is possible not to cause leakage of oil inside the hydraulic chamber.

Next, a fifth embodiment and a sixth embodiment will be described.

In the fifth embodiment and the sixth embodiment, it is possible to separately perform moving and fixing actuation (clamping actuation) of causing a piston housing 60 to move to a predetermined position by the air drive and, then, fixing the piston housing to the cylinder 2 and, then, hydraulic pressure outputting actuation of generating the hydraulic pressure amplified on the front end of the output rod 7 by the air hydraulic mechanism.

Fifth Embodiment

Hereinafter, the fifth embodiment will be described.

In the fifth embodiment, the hydraulic pressure in the radial direction is generated in the second hydraulic chamber 32 by the actuation of the rod portion 58 and the second piston 12 in the fixing actuation, and thereby the thin portion 15 expands, and the movement of the piston housing 60 is fixed to the cylinder 2.

On the other hand, in the hydraulic pressure outputting actuation, the front end of the rod portion 50 pushes the first hydraulic chamber 31 due to the movement of the first piston 11, and thereby the amplified hydraulic pressure amplified is generated by the output rod 7 from the third piston 13.

Figure 7A:
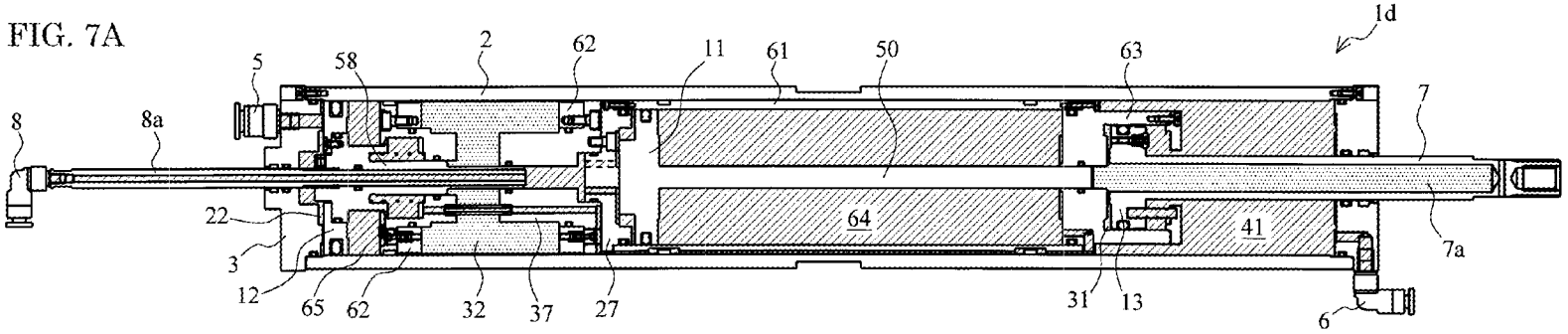
FIGS. 7A and 7B are views for illustrating a cylinder device of a fifth embodiment.
Figure 7B:
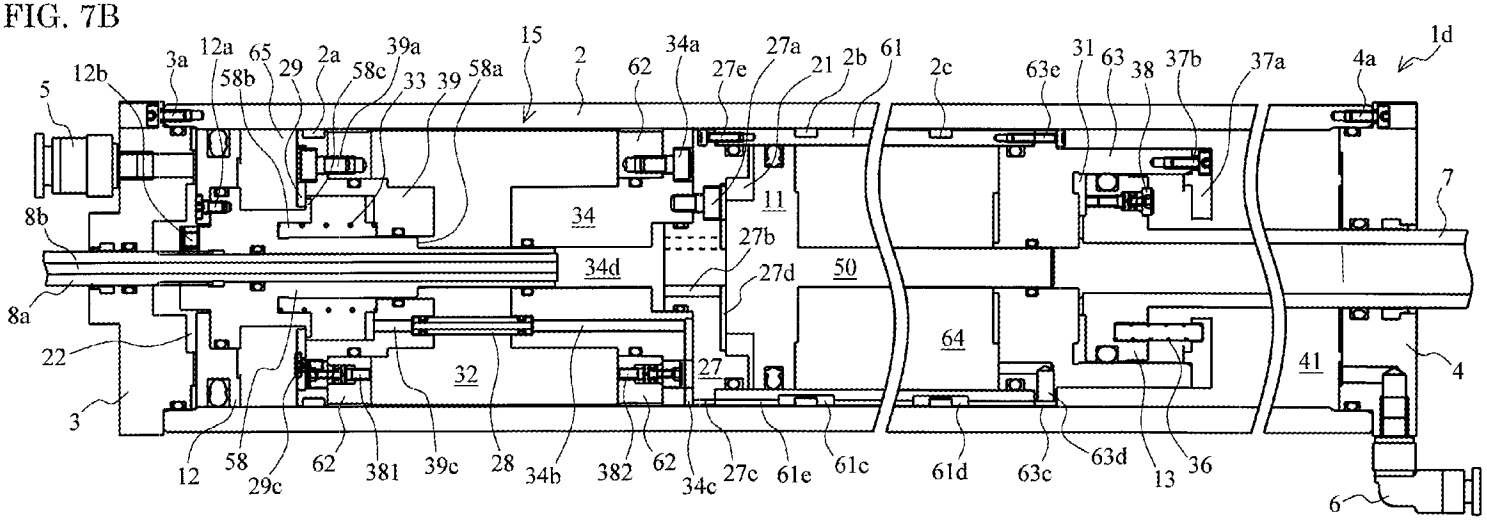

FIGS. 7A and 7B illustrate longitudinal sections in the thrust direction which show a configuration of a cylinder device 1*d* in the fifth embodiment, FIG. 7A illustrates the entire device, and FIG. 7B illustrates an enlarged view of a part thereof.

Figures 8A, 8B:
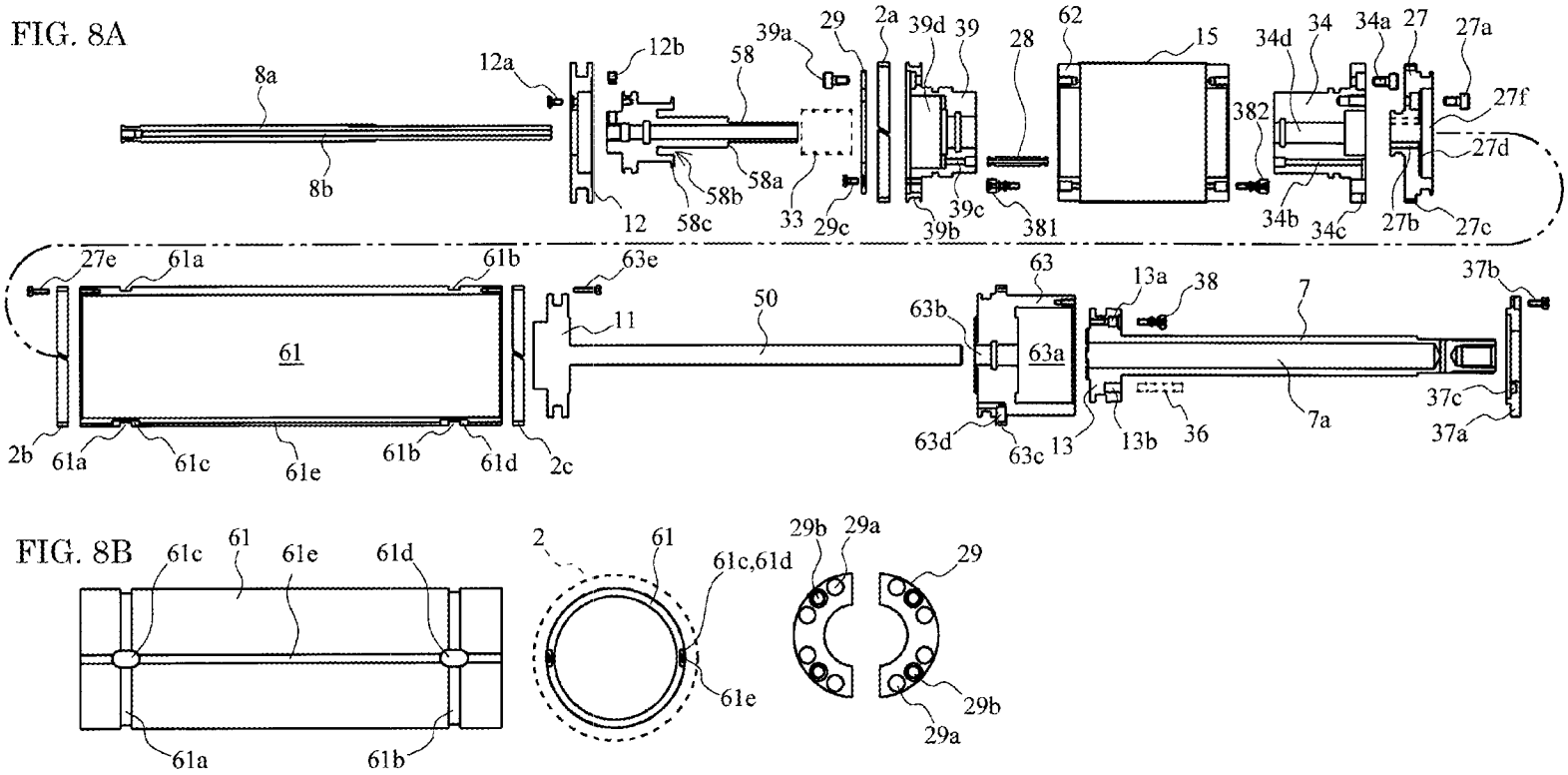
FIGS. 8A and 8B are views of parts of the fifth embodiment.

FIGS. 8A and 8B illustrate parts disposed in the cylinder 2, FIG. 8A illustrates a longitudinal section of the parts, and FIG. 8B is a front view and a side of a first housing 61 and a front view of a retaining ring 29.

The same reference signs are assigned to portions having the same structures or the same functions as those in the first embodiment, and the description thereof is appropriately omitted. In addition, in FIG. 7B, O-rings for sealing portions are illustrated; however, the description thereof is omitted. In addition, in order to make the figure easy to be viewed, similarly to the other embodiments, no distinct mark is applied to the sections, only in FIG. 7A, hatched lines are applied to a region in which the air is present, and dots are applied to a region in which the oil is present.

As illustrated in FIGS. 7A to 8B, in the cylinder device 1*d* of the embodiment, instead of the piston housing 14 (refer to FIG. 1) in the first embodiment, the piston housing 60 (not illustrated) having the first housing 61, a second housing 62, and a third housing 63 is disposed in the cylinder 2.

As illustrated in FIGS. 7A and 7B, the housings are disposed from the input side in the order to the second housing 62 that accommodates the rod portion 58 connected to the second piston 12, the first housing 61 that accommodates the first piston 11 to which the rod portion 50 is continuously connected, and the third housing 63 that accommodates the third piston 13 to which the output rod 7 is continuously connected.

The second housing 62 is provided with thick portions on both end sides, the thin portion 15 is configured between the thick portions, and the second hydraulic chamber 32 is formed in the inner side of the thin portion 15.

The thick portions of the second housing 62 on both ends are provided with an oil supply hole for filling the second hydraulic chamber 32 with the oil. After the oil is injected from either one, the second housing 62 is sealed by an oil filler plug 381 and an oil filler plug 382.

A lid 39 is fixed to the end portion of the second housing 62 on the input side, by a plurality of bolts 39*a* arranged on the circumference thereof. The lid 39 corresponds to the protruding portion 57 in the first embodiment.

The lid 39 has a recessed portion 39*d* (refer to FIG. 8A) with a circular cylinder shape formed on the input side of the lid, and the bottom portion of the recessed portion 39*d* has, at the center thereof, a through-hole for the rod portion 58. On the outer side of the through-hole, a communication hole 39*c* that penetrates through the bottom portion of the recessed portion 39*d* is formed. The communication hole 39*c* configures a part of a path through which a fifth pneumatic chamber 65 communicates with the third pneumatic chamber 41.

The end portion of the lid 39 on the input side is provided with a flange having a clearance from an inner circumferential wall of the cylinder 2, and the circumferential surface of the flange is provided with a sliding assistant ring 2*a*. The sliding assistant ring 2*a* is made of a material (for example, a resin) other than metal, including other sliding assistant rings 2*b* and 2*c*, and is disposed to cause avoidance of metal contact between the cylinder 2, the lid 39, and the first housing 61 and to make smooth sliding between the inner circumferential surface of the cylinder 2 and the second housing 62.

The rod portion 58 is inserted to penetrate through the recessed portion 39*d* of the lid 39 and the through-hole at the center thereof. The second piston 12 is fixed to the rod portion 58 on the input side with a connection screw 12*a*.

The rod portion 58 has a diameter that increases gradually from the output side toward the input side, includes a small-diameter portion, a medium-diameter portion, and a large-diameter portion, and is provided with a step 58*a* on the boundary between the small-diameter portion and the medium-diameter portion. The rod portion 58 moves in the lid 39 in the output direction. In this manner, the second hydraulic chamber 32 formed in the second housing 62 is pressurized, the thin portion 15 is elastically deformed in the radial direction due to the hydraulic pressure, and the piston housings 60 (61 to 63) are fixed in the cylinder 2.

The large-diameter portion of the rod portion 58 is provided with a recessed portion 58*b* formed along the outer circumference of the medium-diameter portion. The medium-diameter portion of the rod portion 58 is inserted into the coil spring 33, one end side of the coil spring 33 is disposed in the recessed portion 58*b*, and the other end side thereof abuts on the bottom surface of the recessed portion 39*d* formed in the lid 39.

The end surface of the large-diameter portion of the rod portion 58 on the output side is provided with a flange 58*c* protruding in the radial direction.

Regarding the rod portion 58, in a state in which the small-diameter portion and the medium-diameter portion of the rod portion 58 inserted into the coil spring 33 penetrate through the lid 39, the retaining ring 29 is fixed to the lid 39 from the input side with a bolt 29*c*. An inner diameter of the retaining ring 29 is formed to be smaller than an outer diameter of the flange 58*c* of the rod portion 58, and thus the coil spring 33 biases the rod portion 58 to the input side such that the rod portion 58 does not slip out.

As illustrated in FIG. 8B, the retaining ring 29 is divided into two portions and is provided with a plurality of holes of a through-hole 29*a* through which the bolt 39*a* (for fixing the lid 39) penetrates on the same circumference and a bolt hole 29*b* for fixing the retaining ring 29 to the lid 39 with the bolt 29*c*. In addition, a joint divided into two portions has a gap without achieving close contact even when the joint is attached to the lid 39, and thus a configuration in which the air in the inside of the fifth pneumatic chamber 65 and the air in the inside of the communication hole 39*c* freely move to and from the insides thereof.

In a state in which the retaining ring 29 is fixed, the second piston 12 is fixed to the rod portion 58 with the connection screw 12*a*. As described above, the rod portion 58 and the second piston 12 are divided because the fixing of the lid 39 with the bolt 39*a* and the fixing of the retaining ring 29 with the bolt 29*c* are performed.

The rod portion 58 is provided with a through-hole at the center, and an inlet/outlet rod 8*a* is inserted into the through-hole. The inlet/outlet rod 8*a* is screwed to the end portion of the rod portion 58 on the input side. Further, the end portion of the rod portion 58 on the input side projects to the input side more than the end surface of the second piston 12, and the inlet/outlet rod 8*a* is fixed in the projecting region with a fixing screw 12*b* in the radial direction.

The lid 3 of the embodiment is provided with a through-hole at the center, and the inlet/outlet rod 8*a* is inserted into the through-hole. The inlet/outlet rod 8*a* is provided with an inlet/outlet channel 8*b* for supplying the air (gas) to the first pneumatic chamber 21. The end portion of the inlet/outlet rod 8*a* on the input side is connected to a third inlet/outlet 8.

The end surface of the second piston 12 on the input side forms, with the lid 39 and the inner circumferential surface of the cylinder 2, the second pneumatic chamber 22, and the end surface of the second piston 12 on the output side forms, with the lid 39 and the cylinder 2, the fifth pneumatic chamber 65.

A part of the lid 34 is inserted into the end portion of the second housing 62 on the output side so as to be opposite to the lid 39. The lid 34 is provided with a flange on the output side and the flange abuts on the end portion of the second housing 62 on the output side. In this manner, the lid 34 is fixed with a bolt 34*a*.

The lid 34 is provided with a communication hole 34*d* formed to penetrate through the lid at the center thereof. The front end (small-diameter portion) of the rod portion 58 passing through the second hydraulic chamber 32 is inserted to an intermediate portion of the communication hole 34*d*.

The lid 34 is provided with a communication hole 34*b* penetrating through the lid 34, the communication hole 34*b* formed on the outer side of the communication hole 34*d*. The communication hole 34*b* and the communication hole 39*c* of the lid 39 communicate with each other through a collar 28 having an inner side disposed in the second hydraulic chamber 32.

The end surface of the lid 34 on the output side is provided with a communication groove 34*c* in the radial direction which is connected to the communication hole 34*b*.

The first housing 61 is disposed on the output side from the second housing 62, and a lid 27 is fixed to the end portion of the first housing 61 on the input side with a plurality of bolts 27*e*.

The lid 27 is fixed to the lid 34 with a bolt 27*a* from the inner side of the second housing 62 in a state of being fixed to the second housing 62. In this manner, the communication groove 34*c* formed in the lid 34 is covered with the lid 27, and an air passage is formed from the fifth pneumatic chamber 65.

The lid 27 is provided with a recessed portion 27*f* (refer to FIG. 8A) on the output side. The recessed portion 27*f* functions as the end surface of the first pneumatic chamber 21 on the input side.

The lid 27 is provided with a communication hole 27*b* that penetrates through the bottom surface of the recessed portion 27*f* and communicates with the communication hole 34*d* of the lid 34, and the bottom surface of the recessed portion 27*f* is provided with a communication groove 27*d* in the radial direction which is connected to the communication hole 27*b*.

In addition, the outer circumferential surface of the lid 27 is provided with a communication groove 27*c* in an axial direction which is connected to the communication groove 34*c* of the lid 34.

In a state in which the lid 27 is fixed to the lid 34 with the bolt 27*a*, the first piston 11 to which the rod portion 50 extends is disposed in the first housing 61 at the center thereof.

The disposition of the first piston 11 causes the first housing 61 to be partitioned by the first piston 11. Thus, the first pneumatic chamber 21 is formed on the input side and a fourth pneumatic chamber 64 is formed on the output side.

As illustrated in FIGS. 8A and 8B, the first housing 61 is provided with circumferential grooves 61*a* and 61*b* along the entire circumference thereof on both end sides. As described above, the sliding assistant rings 2*b* and 2*c* are fitted in the circumferential groove 61*a*, and thus smooth sliding between the cylinder 2 is performed.

In addition, the first housing 61 is provided with a communication groove 61*e* along the entire length thereof in the axial direction (longitudinal direction). The end portion of the communication groove 61*e* on the input side is connected to the communication groove 27*c* of the lid 27.

In order not to block the communication hole 61*e* with the sliding assistant rings 2*b* and 2*c* fitted into the circumferential grooves 61*a* and 61*b*, recessed portions 61*c* and 61*d* are formed that have a width wider than the width of the sliding assistant rings 2*b* and 2*c* and are deeper than the thickness of the sliding assistant rings, at a position at which the circumferential grooves 61*a* and 61*b* intersect with the communication groove 61*e*. A passage of the air from the fifth pneumatic chamber 65 is formed between the communication groove 61*e* and the inner circumferential surface of the cylinder 2.

Back to FIGS. 7A and 7B, the third housing 63 is fixed, with a plurality of bolts 63*e*, to the end portion of the first housing 61 on the output side, in which the first piston 11 is disposed on the inner side.

The third housing 63 is provided with a recessed portion 63*a* formed on the output side thereof (refer to FIGS. 8A and 8B). The bottom surface of the recessed portion 63*a* is provided with a through-hole 63*b* at the center, and the rod portion 50 is inserted into the through-hole 63*b*.

The third housing 63 is provided with a flange formed at an intermediate portion thereof in the axial direction, and the flange is provided with a groove 63*c* formed on the outer circumference in the radial direction.

In addition, the flange of the third housing 63 is provided with a communication hole 63*d* having an L-shaped section which extends from a position, at which the communication hole 63*d* is connected to the groove 63*c* in the radial direction, and is bent in the axial direction from an intermediate portion.

The communication hole 63*d* having the L-shaped section penetrates to the end surface of the third housing 63 on the input side and is connected to the fourth pneumatic chamber 64.

On the other hand, the input side of the groove 63*c* is connected to the communication groove 61*e* formed on the outer circumference of the first housing 61, and the output side thereof is connected to the third pneumatic chamber 41.

The third piston 13 including the output rod 7 at the center thereof is disposed in the recessed portion 63*a* of the third housing 63.

The disposition of the third piston 13 causes the recessed portion 63*a* of the third housing 63 to be partitioned, and the hydraulic chamber 31 is formed on the input side.

The third piston 13 is provided with an oil supply hole for filling the first hydraulic chamber 31 with the oil. After the oil is injected, the third piston 13 is sealed by the oil filler plug 38.

A cavity 7*a* is formed at the center of the first hydraulic chamber 31 and the output rod 7 and does not penetrate in the axial direction. The cavity 7*a* also configures the first hydraulic chamber 31 and the inside of the cavity 7*a* is also filled with the oil.

The inner diameter of the cavity 7*a* is formed to be larger than the diameter of the rod portion 50, and thus the rod portion 50 enters and exits from the cavity.

A retaining ring 37*a* is fixed with a plurality of bolts 37*b* to the end portion of the third housing 63 on the output side. The fixing of the retaining ring 37*a* is performed in a state in which the third piston 13 is disposed in the recessed portion 63*a*, is filled with the oil, and is sealed with the oil filler plug 38.

A recessed portion 13*b* and a recessed portion 37*c* are formed in surfaces of the third piston 13 and the retaining ring 37*a* which are opposite to each other, respectively, and the coil spring 36 that biases the third piston 13 to the input side is disposed in the recessed portions.

The second housing 62 configures, with the lid 39 and the lid 34, an input-side housing, and the first housing 61 and the third housing 63 configure, with the lid 27 and the retaining nut 37, an output-side housing.

In addition, the lid 34 and the lid 27 are fixed with the bolt 27*a*, and thereby the input-side housing is fixed to the input side (one end side) of the output-side housing.

Next, two types of actuation performed by the cylinder device 1*d* of the fifth embodiment will be described.

First Actuation

Figures 9A, 9B, 9C:
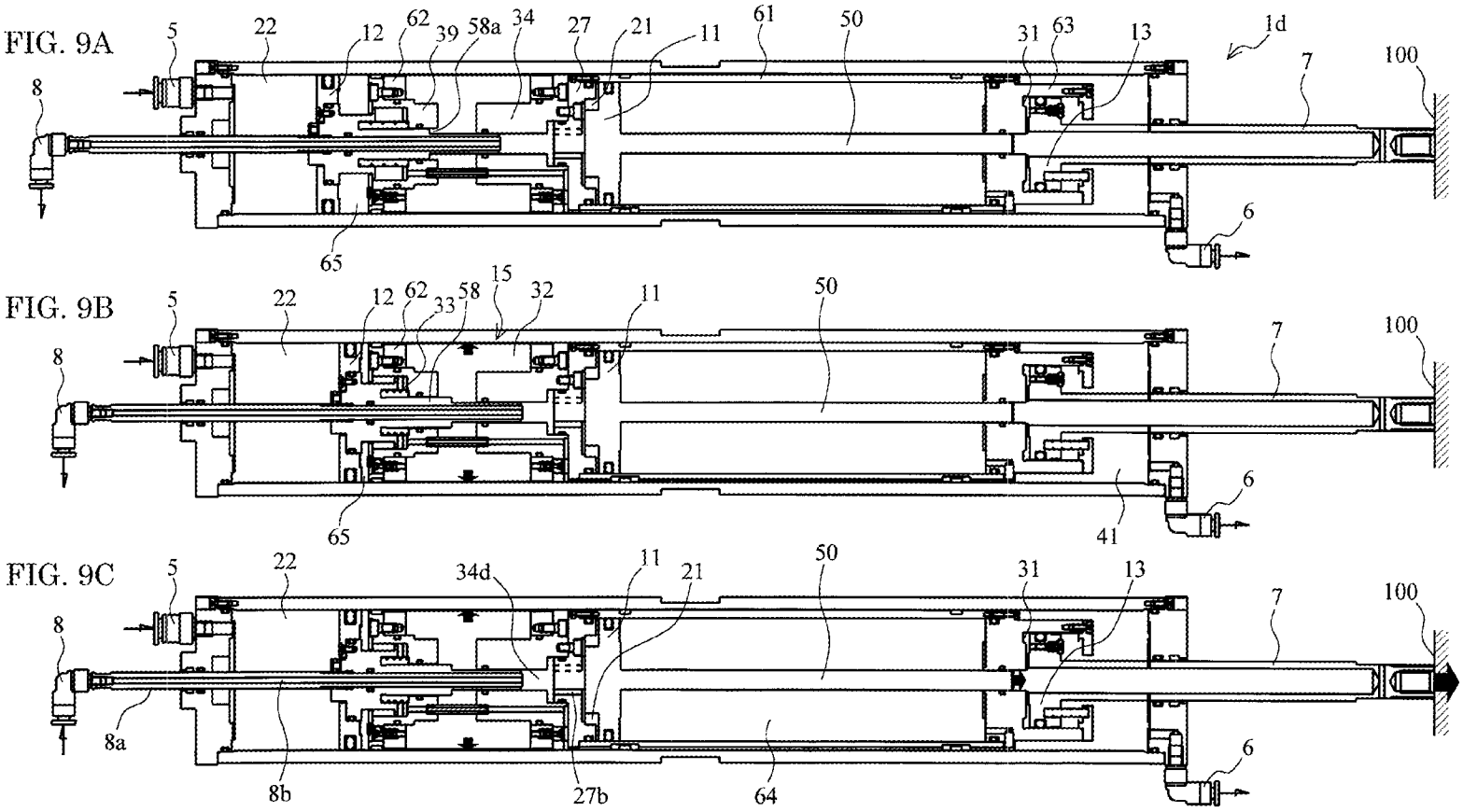
FIGS. 9A to 9C are views for illustrating an actuation state of the fifth embodiment.

FIGS. 9A to 9C illustrate states of first actuation performed by the cylinder device 1*d*.

In the first actuation, the front end of the output rod 7 abuts on the workpiece 100, and thereby fixing of the piston housings 60 (61, 62, and 63) is formed. Then, the amplified hydraulic pressure is output from the front end of the output rod 7 at any timing.

First, actuation of causing the cylinder device 1*d* to come into the initial state is described with reference to FIGS. 7A and 7B.

The initial state of the cylinder device 1*d* corresponds to a state illustrated in FIGS. 7A and 7B in a state in which the piston housing 60 and the second piston 12 in the cylinder 2 move to the input side.

In order for the device to come into the initial state, the air is supplied from the second inlet/outlet 6 with predetermined pressure in a state in which the first inlet/outlet 5 and the third inlet/outlet 8 are opened. The air supplied to the third pneumatic chamber 41 presses the end surface of the piston housing 60 on the output side which forms the third pneumatic chamber 41, and all of the piston housings start to move in the input direction. Simultaneously, the air supplied to the third pneumatic chamber 41 reaches the fifth pneumatic chamber 65 through the groove 63*c*, the recessed portion 61*d*, the recessed portion 61*c*, the communication groove 61*e*, the communication groove 27*c*, the communication groove 34*c*, the communication hole 34*b*, the collar 28, and the communication hole 39*c*. The air supplied to the fifth pneumatic chamber presses the end surface of the second piston 12 on the output side and the second piston 12 moves to the input side. At this time, since the first inlet/outlet 5 is opened, the second piston 12 and the rod portion 58 do not receive pneumatic pressure in the output direction by the second pneumatic chamber 22 and, thus, can easily move in the input direction.

In addition, since the flange 58*c* of the rod portion 58 engages with the retaining ring 29, all of the piston housings 60 also simultaneously move. Here, since the air supplied to the third pneumatic chamber 41 presses the end surface of the piston housing 60 on the output side, all of the piston housings 60 move to the input side. At this time, the internal pressure due to the air supplied to the fifth pneumatic chamber 65 also simultaneously presses the end surface of the piston housing 60 on the input side, and thereby the piston housing moves due to the bias of the coil spring 33 while the space of the fifth pneumatic chamber 65 is maintained as it is. The inlet/outlet rod 8*a* engaging with the rod portion 58 also moves.

The air in the second pneumatic chamber 22 is discharged from the first inlet/outlet 5 in association with the movement to the input side.

In addition, the supplied air passes from the third pneumatic chamber 41 through the groove 63*c* and the communication hole 63*d*, and the pressure in the fourth pneumatic chamber 64 is increased. The first piston 11 moves to the input side until the first piston 11 abuts on the lid 27 due to the pressure from the fourth pneumatic chamber 64. At this time, the air in the first pneumatic chamber 21 is pushed by the first piston 11 and is released from the third inlet/outlet 8 through the communication groove 27*d*, the communication hole 27*b*, the communication hole 34*d*, and the inlet/outlet channel 8*b*.

The output rod 7 and the third piston 13 are biased to the input side by the increase in pressure of the third pneumatic chamber 41 and the coil spring 36 and move to the input side. Simultaneously, a space of the recessed portion 63*a* of the first hydraulic chamber 31 is reduced due to the oil of the first hydraulic chamber 31 which flows from the recessed portion 63*a* to the cavity 7*a* of the output rod 7, in association with the movement of the first piston 11, and the third piston 13 move to the input side. The third piston 13 moves until the third piston 13 abuts on the bottom surface of the recessed portion 63*a* of the third housing 63.

The cylinder device 1*d* comes into the initial state illustrated in FIGS. 7A and 7B by the movement described above.

As illustrated in FIG. 9A, in the initial state, with the third inlet/outlet 8 opened, the second inlet/outlet 6 is opened and the air is supplied from the first inlet/outlet 5.

Then, the pressure of the second pneumatic chamber 22 is increased and pushes the second piston 12 to the output side, and the second piston 12 presses the second hydraulic chamber 32 via the rod portion 58. At this time, since a reaction force of the pressing force to the output side does not act on all of the piston housings 60, the oil of the second hydraulic chamber 32 is not confined and the thin portion 15 is not elastically deformed. Therefore, the rod portion 58 presses the second hydraulic chamber 32, and thereby all of the piston housings 60 move to the output side. The coil spring 33 assists in pushing the entire piston housing 60 to the output side.

Since the third inlet/outlet 8 is opened, the pneumatic pressure of the first pneumatic chamber 21 is not increased. Therefore, the first piston 11 and the rod portion 50 are maintained to abut on the lid 27 without moving in the output direction. In addition, since the rod portion 50 does not move in the output direction, the hydraulic pressure in the first hydraulic chamber 31 is not increased, and the third piston 13 is also maintained to abut on the third housing 63.

As illustrated in FIG. 9A, the output rod 7 moves in the output direction along with the movement of the second piston 12 and the piston housing 60, and the front end portion of the output rod 7 abuts on the workpiece 100.

When the output rod 7 abuts on the workpiece 100, the third piston 13 abuts on the third housing 63, and thus the movement of all of the piston housings 60 is stopped.

In this state, as illustrated in FIG. 9B, the air is further supplied from the first inlet/outlet 5. Since the movement of the piston housing 60 is stopped, the pressure in the second pneumatic chamber 22 is further increased and exceeds a bias force by the coil spring 33 in the input direction, and the second piston 12 and the rod portion 58 moves in the output direction.

The volume of the fifth pneumatic chamber 65 decreases due to the movement of the second piston 12; however, the air in the fifth pneumatic chamber 65 moves to the third pneumatic chamber 41 and is discharged from the second inlet/outlet 6. As illustrated in FIGS. 7A and 7B, a specific route of discharge is from the fifth pneumatic chamber 65 through the recessed portion 39*d*, the communication hole 39*c*, the collar 28, the communication groove 61*e*, the communication hole 34*b*, the communication groove 34*c*, the communication groove 27*c*, the communication groove 61*e*, the groove 63*c*, and the third pneumatic chamber 41 to the second inlet/outlet 6.

The movement of the rod portion 58 causes the second hydraulic chamber 32 to be pressed by the step 58*a*, and the internal pressure is increased. As illustrated by an arrow in the radial direction in FIG. 9B, the thin portion 15 is elastically deformed to the outer side due to the hydraulic pressure, and the piston housing 60 comes into a state of being fixed to the cylinder 2 from a state in which the movement is only stopped.

In the state in which the piston housing is not fixed by the thin portion 15, the piston housing 60 is in a state of being only stopped without moving.

In a non-fixed state (state in FIG. 9A), when the supply of the air from the first inlet/outlet 5 is stopped and the air is supplied from the third inlet/outlet 8, all of the piston housings 60 moves in the reverse direction (input direction). In other words, the first piston 11 and the rod portion 50 move due to the pressure of the first pneumatic chamber 21 such that the hydraulic pressure in the first hydraulic chamber 31 is increased; however, since the output rod 7 is fixed to the workpiece 100, all of the piston housings 60 move in the reverse direction (input direction) due to the reaction force from the workpiece 100.

Regarding whether or not the piston housing 60 is fixed due to the elastic deformation of the thin portion 15, a strain gauge (not illustrated) is disposed on the outer circumference of the cylinder 2, deformation strain of the cylinder 2 due to the pressing force by the thin portion 15 to the cylinder 2 is detected, and the fixing of the piston housing 60 is determined by detecting a predetermined amount of strain. Otherwise, a pressure sensor (not illustrated) that detects pressure in the second hydraulic chamber 32 may be disposed, and determination may be performed by whether or not the pressure exceeds a predetermined value (value of the elastic deformation of the thin portion 15). A detection target by the pressure sensor may be the second pneumatic chamber 22. In addition, instead of the pressure sensor, a sensor that detects the movement of the output rod 7 or a sensor that detects the movement of the inlet/outlet rod 8*a* may be provided, and determination of fixing may be performed after a predetermined period of time (a period of time until the pressure of the second hydraulic chamber is increased and the thin portion 15 is elastically deformed) elapses from the stop of the movement.

In the state illustrated in FIG. 9B in which the piston housing 60 is fixed to the cylinder 2 due to the elastic deformation of the thin portion 15, the amplified thrust is not output from the front end of the output rod 7 only because the output rod 7 abuts on the workpiece 100.

As illustrated in FIG. 9C, when the air is supplied from the third inlet/outlet 8 in a desired timing, the supplied air passes through the inlet/outlet channel 8*b*, the communication hole 34*d*, and the communication hole 27*b* and increases the pressure of the first pneumatic chamber 21.

The first piston 11 receives the pressure of the first pneumatic chamber 21, the front end of the rod portion 50 presses the first hydraulic chamber 31, and the third piston 13 receives the amplified hydraulic pressure. The third piston 13 receives the amplified hydraulic pressure such that the large thrust is output from the output rod 7 to the workpiece 100.

Second Actuation

Next, second actuation from the initial state illustrated in FIGS. 7A and 7B will be described.

Figures 10A, 10B, 10C:
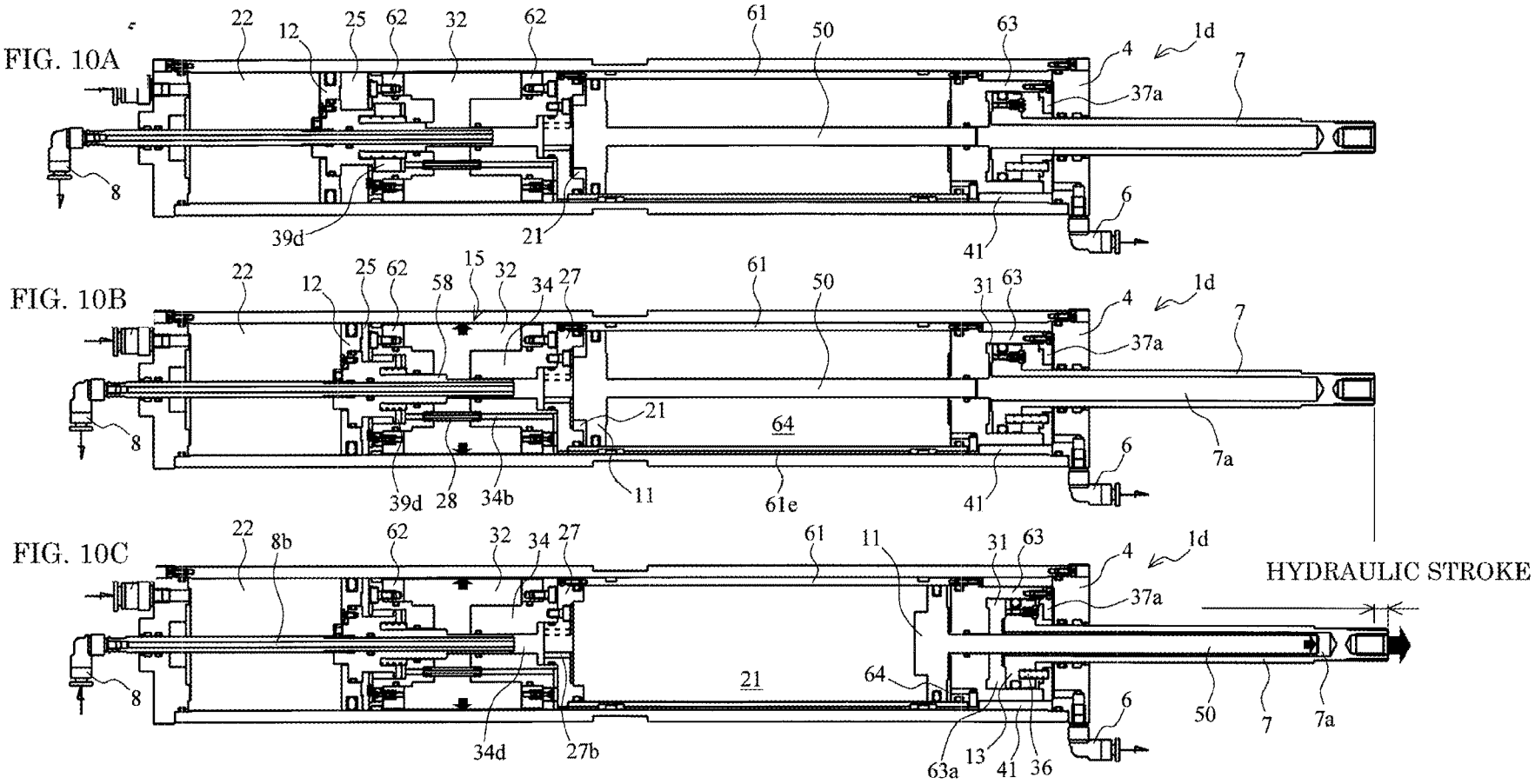
FIGS. 10A to 10C are views for illustrating another actuation state of the fifth embodiment.

FIGS. 10A to 10C illustrate states of the second actuation performed by the cylinder device 1*d*.

In the second actuation, the end portion (retaining ring 37*a*) of the piston housing 60 on the output side abuts on the lid 4 before the front end of the output rod 7 abuts on the workpiece 100, and thereby fixing of the piston housings 60 is formed. Then, the amplified hydraulic pressure is output from the front end of the output rod 7 at any timing.

As illustrated in FIG. 10A, in the initial state, with the third inlet/outlet 8 opened, the second inlet/outlet 6 is opened and the air is supplied from the first inlet/outlet 5.

Similar to the description in FIG. 9A, the supply of the air causes the second piston 12 and the piston housings 60 (61, 62, and 63) to move in the output direction.

Unlike the first actuation in which the front end of the output rod 7 abuts on the workpiece 100 such that the movement of the piston housing 60 is stopped, the retaining ring 37*a* abuts on the lid 4, and thereby the movement of all of the piston housings 60 are stopped in the second actuation.

In this state, as illustrated in FIG. 10B, the air is further supplied from the first inlet/outlet 5. Similar to the first actuation described with reference to FIG. 9B, the rod portion 58 moves due to the increase in pressure in the second pneumatic chamber 22, and the hydraulic pressure of the second hydraulic chamber 32 is increased. In this manner, the thin portion 15 is elastically deformed such that all of the piston housings 60 are fixed to the cylinder 2.

From the state of FIG. 10B in which the piston housing 60 is fixed to the cylinder 2 due to the elastic deformation of the thin portion 15, the air is supplied from the third inlet/outlet 8 at a desired timing. Then, the supplied air passes through the inlet/outlet channel 8*b*, the communication hole 34*d*, and the communication hole 27*b* and increases the pressure of the first pneumatic chamber 21. The first piston 11 receives the increased pressure, and thereby the front end of the rod portion 50 presses the first hydraulic chamber 31.

The second actuation is the same as the first actuation to this, by the air supply from the third inlet/outlet 8.

However, as illustrated in FIG. 10B, in the second actuation, since the front end of the output rod 7 does not abut on any portion, the third piston 13 and the output rod 7 can move in the output direction.

Therefore, the first piston 11 and the rod portion 50 move in the output direction and enter the cavity 7*a* of the output rod 7 while the front end of the rod portion 50 presses the first hydraulic chamber 31.

In this manner, the oil in the cavity 7*a* moves to the side of the recessed portion 63*a* of the first hydraulic chamber 31 through a space between the outer circumferential surface of the rod portion 50 and the inner circumferential surface of the output rod 7. The third piston 13 moves in the output direction due to the movement of the oil in the first hydraulic chamber 31 to a distance in proportion to a length of a stroke of the insertion of the rod portion 50 into the inside of the first hydraulic chamber 31.

In this state, the third piston 13 receives the hydraulic pressure increased due to the pressing of the first hydraulic chamber 31 by the front end of the rod portion 50, and thereby the large thrust is output from the front end of the output rod 7.

When Lh represents a movement distance (hydraulic stroke) of the output rod 7 until the rod portion 50 moves in the cavity 7*a* and the thrust is output from the output rod 7, La represents a length of a stroke of the insertion of the rod portion 50 into the inside of the first hydraulic chamber 31 (=movement distance of the first piston 11), Sa represents a sectional area of the rod portion 50 on the output side in the first hydraulic chamber 31, and Sh represents a sectional area of the third piston 13 and the output rod 7 on the input side in the first hydraulic chamber 31. A relationship of the following expression is satisfied.

$$Lh = La \times (Sa/Sh)$$

As described above, according to the fifth embodiment, the third inlet/outlet 8 for generating the thrust from the front end of the output rod 7 is provided, separately from the first inlet/outlet 5 for increasing the hydraulic pressure of the second hydraulic chamber 32 so as to fixing the piston housing 60 to the cylinder 2.

In this manner, it is possible to perform the fixing actuation of the piston housing 60 independently from the thrust generating actuation from the output rod 7.

In addition, according to the fifth embodiment, even in the state in which the output rod 7 abuts on the workpiece 100 or even in the state in which the output rod does not abut on the workpiece (the state in which the retaining ring 37*a* abuts on the lid 4), it is possible to output, from the front end of the output rod 7, the thrust amplified due to the hydraulic pressure of the first hydraulic chamber 31.

Here, a difference in state change of the hydraulic chambers between the first embodiment and the fifth embodiment is described below.

As described above, in the first embodiment, the first hydraulic chamber 31 and the second hydraulic chamber 32 simultaneously start increasing the pressure. In other words, unlike the fifth embodiment, since the first pneumatic chamber 21 and the second pneumatic chamber 22 communicate with each other through the communication hole in the first embodiment, the hydraulic pressure generating unit 55 moves such that the front end of the output rod 7 abuts on the workpiece 100, and then the air is simultaneously supplied to the first pneumatic chamber 21 and the second pneumatic chamber 22 from the first inlet/outlet 5. In this manner, the first piston 11 and the second piston 12 simultaneously start to move, and the deformation of the thin portion 15 and the pressing to the output rod 7 are started.

Here, since the output rod 7 abuts on the workpiece and does not move, the pressure of the first hydraulic chamber 31 is also applied to the end surface of the lid 34 on the output side. In this manner, the pressure of the first hydraulic chamber 31 presses the lid 34 to the input side and presses the hydraulic pressure generating unit 55 to the input side. Simultaneously, the pressure of the second hydraulic chamber 32 is applied to the end surface of the lid 34 on the input side such so as to press the lid 34 to the output side and to press the hydraulic pressure generating unit 55 to the output side. In a force relationship at this time, in a case where a force of pressing the hydraulic pressure generating unit 55 to the input side is large via the lid 34, the members move to the input side except for the first piston 11 and the second piston 12 that move to the output side due to the air supplied from the first inlet/outlet 5, and the output rod 7 that is pressed by the first hydraulic chamber 31.

Therefore, before the first piston 11 abuts on the retaining nut 18 and the gap 51 therebetween disappears, the second piston 12 needs to move forward and to be fixed to the cylinder 2 with the thin portion 15 deformed. In other words, the actuation of the second piston 12 needs to be performed faster than the actuation of the first piston 11. This is because the actuation of the second piston 12 causes the thin portion 15 to be deformed is performed faster than the actuation of the first piston over the distance of the gap 51, and thereby the hydraulic pressure generating unit 55 is reliably fixed, and then the hydraulic thrust is stably generated to the output rod 7 in association with the increase in the pressure of the first hydraulic chamber.

In the first embodiment, the second piston 12 is configured to be lighter than the first piston 11. In addition, the sliding resistance acting during the actuation of the pistons is set such that the actuation of the second piston 12 is faster than the actuation of the first piston 11. The difference in sliding resistance described above is set by a difference in material or shape of the seal members used in the pistons or a difference in interference during the attachment.

Sixth Embodiment

Next, the sixth embodiment will be described.

In the sixth embodiment, it is possible to automatically perform, by using a check valve (ball check valve) 54, the fixing actuation (clamping actuation) of causing the piston housing 60 to be fixed to the cylinder 2 due to the amplified hydraulic pressure and hydraulic pressure outputting actuation of generating the hydraulic pressure amplified on the front end of the output rod 7 by the air hydraulic mechanism.

Figure 11A:
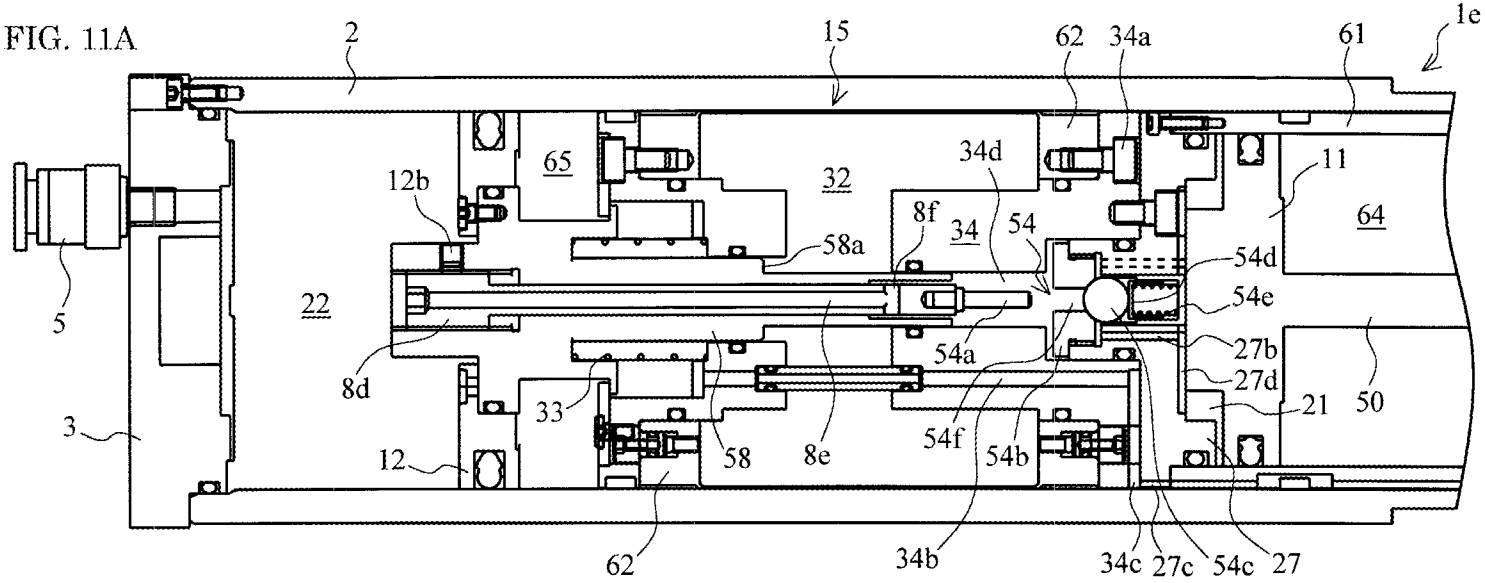
FIGS. 11A and 11B are views for illustrating a cylinder device of a sixth embodiment.
Figure 11B:
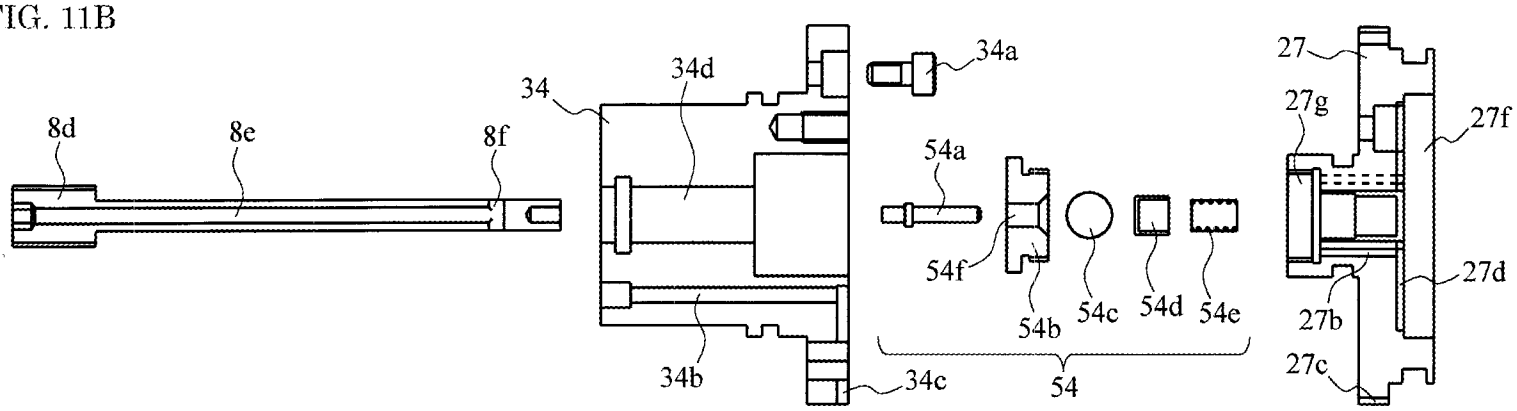

FIGS. 11A and 11B are a sectional view illustrating a part of a cylinder device 1*e* of the sixth embodiment and a sectional view illustrating parts thereof, respectively.

FIGS. 11A and 11B illustrate a periphery of the check valve 54 specific in the sixth embodiment, and the other portions are the same as those of the cylinder device 1*d* of the fifth embodiment illustrated in FIGS. 7A to 8B.

As illustrated in FIGS. 11A and 11B, in the cylinder device 1*e*, the check valve 54 is disposed between the lid 27 that is fixed to the end portion of the first housing 61 on the input side and the lid 34 that is fixed to the end portion of the second housing 62 on the output side.

The check valve 54 includes an opening/closing rod 54*a* that is attached to the front end of a communication rod 8*d*, a stop ring 54*b*, a spherical body 54*c*, a circular cylindrical member 54*d*, and a coil spring 54*e*.

The lid 27 is provided with a recessed portion 27*g* in which the check valve 54 is accommodated. In a state in which the spherical body 54*c*, the circular cylindrical member 54*d*, and the coil spring 54*e* are accommodated in the recessed portion 27*g*, the stop ring 54*b* is screwed to the lid 27.

The coil spring 54*e* is disposed between the bottom portion of the recessed portion 27*g* and the bottom portion of the circular cylindrical member 54*d* and biases the spherical body 54*c* via the check valve 54 in the input direction, and thereby a vent hole 54*f* formed in the stop ring 54*b* is closed by the spherical body 54*c*.

The input side of the inlet/outlet rod 8*a* in the fifth embodiment penetrates through the lid 3, the end portion thereof is connected to the third inlet/outlet 8, and a communication channel 8*e* penetrates in the axial direction (refer to FIGS. 7A and 7B).

By comparison, as illustrated in FIGS. 11A and 11B, the communication rod 8*d* of the embodiment which corresponds to the inlet/outlet rod 8*a* have the end portion on the input side which is formed to the end surface of the rod portion 58 on the input side, and an inlet/outlet channel 8*e* communicates with the second pneumatic chamber 22.

On the other hand, the end portion of the communication rod 8*d* on the output side does not penetrate in the axial direction but is connected to the communication channel 8*f* formed to penetrate in the radial direction slightly in front of the front end surface.

Similar to the fifth embodiment, the communication rod 8*d* is inserted into the through-hole formed in the rod portion 58, is screwed at the end portion on the input side, and is fixed with the fixing screw 12*b* in the radial direction.

Unlike the fifth embodiment, the through-hole formed in the rod portion 58 is formed to have an inner diameter on the front end side (the small-diameter portion on the output side) which is larger than an outer diameter of the communication rod 8*d* on the output side.

In this manner, the air in the second pneumatic chamber 22 passes through the communication channel 8*f* from the communication channel 8*e*, passes between the outer circumference of the communication rod 8*d* and the through-hole of the rod portion 58, and is supplied to the communication hole 34*d*.

The front end of the communication rod 8*d* is provided with a recessed portion formed along the central axis, and the opening/closing rod 54*a* of the check valve 54 is press-fitted in the recessed portion.

The communication rod 8*d* functions as communication means, with the check valve 54, the communication hole 27*b*, and the communication groove 27*d*, through which the second pneumatic chamber 22 communicates with the first pneumatic chamber 21.

Next, first actuation and second actuation performed by the cylinder device 1*e* of the sixth embodiment will be described.

First Actuation

Figures 12A, 12B, 12C:
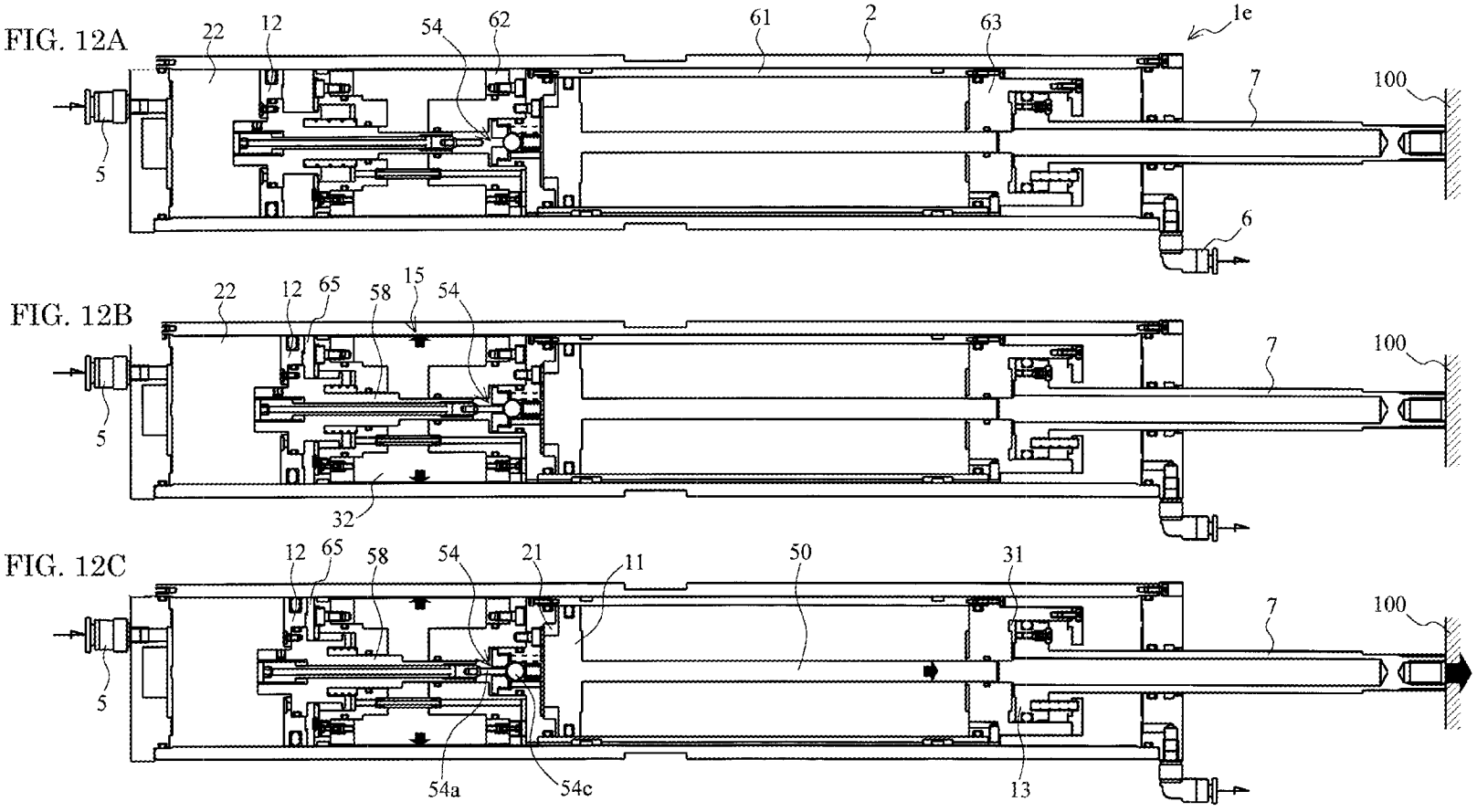
FIGS. 12A to 12C are views for illustrating an actuation state of the sixth embodiment.

FIGS. 12A to 12C illustrate states of the first actuation performed by the cylinder device 1*e*.

In the first actuation, the front end of the output rod 7 abuts on the workpiece 100, and thereby the actuation of fixing the piston housing 60 is performed and an automatic operation of the check valve (ball check valve) 54 are continuously performed. Then, the amplified hydraulic pressure is output from the front end of the output rod 7.

In a case of causing the cylinder device 1*e* to come into the initial state, the air is supplied from the second inlet/outlet 6 with predetermined pressure in a state in which the first inlet/outlet 5 is opened. In this manner, the portions in the cylinder 2 move to the input side; however, the movement is the same as that in the fifth embodiment.

FIGS. 11A and 11B do not illustrate the initial state but illustrate a state of movement to the output side.

As illustrated in FIG. 12A, in the initial state, the second inlet/outlet 6 is opened and the air is supplied from the first inlet/outlet 5.

Then, the pressure of the second pneumatic chamber 22 is increased and pushes the second piston 12 to the output side, and the second piston 12 presses the second hydraulic chamber 32 with the rod portion 58. Here, since the reaction force of the pressing force of the movement to the output side does not act on all of the piston housings 60, the oil of the second hydraulic chamber 32 is not confined and the thin portion 15 is not elastically deformed. Therefore, the rod portion 58 presses the second hydraulic chamber 32, and thereby all of the piston housings 60 move to the output side. The coil spring 33 assists in pushing all of the piston housings 60 to the output side. In the actuation, particularly in the same actuation described in FIG. 9A, the output rod 7 moves in the output direction, and the front end portion of the output rod abuts on the workpiece 100.

The pressure of the communication hole 34*d* is increased through the communication channels 8*e* and 8*f* due to the pressure increased in the second pneumatic chamber 22; however, a bias force of the coil spring 54*e* (refer to FIGS. 11A and 11B) is larger than the pneumatic pressure. Therefore, the check valve 54 maintains a state of being sealed.

When the output rod 7 abuts on the workpiece 100, the third piston 13 abuts on the third housing 63, and thus the movement of all of the piston housings 60 is stopped.

As illustrated in FIG. 12B, in this state, when the air is further supplied from the first inlet/outlet 5, the pressure in the second pneumatic chamber 22 exceeds the bias force by the coil spring 33, and the second piston 12 and the rod portion 58 moves in the output direction.

In this manner, the second hydraulic chamber 32 is pressed by the step 58*a*, and the internal pressure is increased. The thin portion 15 is elastically deformed to the outer side, and all of the piston housings 60 come into a state of being fixed to the cylinder 2 from a state in which the movement is stopped.

FIG. 12C illustrates a state in which the opening/closing rod 54*a* fixed to the front end of the rod portion 58 pushes the spherical body 54*c* and the check valve 54 is opened, simultaneously in a state in which the piston housing 60 is fixed to the cylinder 2 due to the elastic deformation of the thin portion 15.

When the cylinder device comes into this state, the air supplied from the first inlet/outlet 5 passes from the second pneumatic chamber 22 through the inlet/outlet channel 8*e*, the communication hole 34*d*, the vent hole 54*f*, the recessed portion 27*g*, the communication hole 27*b*, and the communication groove 27*d* (refer to FIGS. 11A and 11B) and increases the pressure of the first pneumatic chamber 21.

Then, the first piston 11 receives the pressure of the first pneumatic chamber 21, the front end of the rod portion 50 presses the first hydraulic chamber 31, and the third piston 13 receives the amplified hydraulic pressure. The third piston 13 received the amplified hydraulic pressure such that the large thrust is output from the output rod 7 to the workpiece 100.

At this time, as long as the fixing of the second housing 62 (a state in FIG. 12B) and pushing of the spherical body 54*c* by the opening/closing rod 54*a* so as to open the check valve 54 (a state in FIG. 12C) are almost simultaneously performed, either of the fixing or the pushing may be early performed. In a case where the fixing of the second housing 62 is early performed, the seal member attached to the second piston 12 or the rod portion 58 is elastically deformed due to the pressurization of the second pneumatic chamber 22, and thereby the rod portion 58 further moves to the output side and the check valve 54 is opened.

In a case where the opening of the check valve 54 is performed slightly early, the air is first supplied to the first pneumatic chamber 21 for a little period of time, and the third hydraulic chamber 31 is pressurized. Therefore, the output rod 7 slightly moves; however, a distance of the movement of the first piston 11 is small, and the movement distance Lh of the output rod 7 does not significantly influence the entire stroke because moving is performed only by Lh=La×(Sa/Sh). However, while the second hydraulic chamber 32 is not fixed, it is not possible to generate large hydraulic pressure to the output rod 7.

Also in the cylinder device 1*e* of the sixth embodiment, in a state in which the piston housing is not fixed by the thin portion 15 (a state in FIG. 12A), the piston housing 60 is in a state of being only stopped without moving.

Similar to the fifth embodiment, regarding whether or not the piston housing 60 is fixed due to the elastic deformation of the thin portion 15, a strain gauge (not illustrated) is disposed on the outer circumference of the cylinder 2, deformation strain of the cylinder 2 due to the pressing force by the thin portion 15 to the cylinder 2 is detected, and the fixing of the piston housing 60 is determined by detecting a predetermined amount of strain. Otherwise, a pressure sensor (not illustrated) that detects pressure in the second hydraulic chamber 32 may be disposed, and determination may be performed by whether or not the pressure exceeds a predetermined value (value of the elastic deformation of the thin portion 15). A detection target by the pressure sensor may be the second pneumatic chamber 22. In addition, instead of the pressure sensor, a sensor that detects the movement of the output rod 7 may be provided, and determination of fixing may be performed after a predetermined period of time (a period of time until the pressure of the second hydraulic chamber is increased and the thin portion 15 is elastically deformed) elapses from the stop of the movement.

In the fifth and sixth embodiments, the strain gauge is disposed on the outer circumference of the cylinder 2, the deformation strain of the cylinder 2 due to the pressing force by the thin portion 15 to the cylinder 2 is detected, and the fixing of the piston housing 60 is determined; however, also similar to the first to fourth embodiments, the strain gauge is disposed and whether or not the piston housing 14 is fixed due to the elastic deformation of the thin portion 15 may be determined.

Second Actuation

Next, the second actuation from the initial state will be described.

Figures 13A, 13B, 13C:
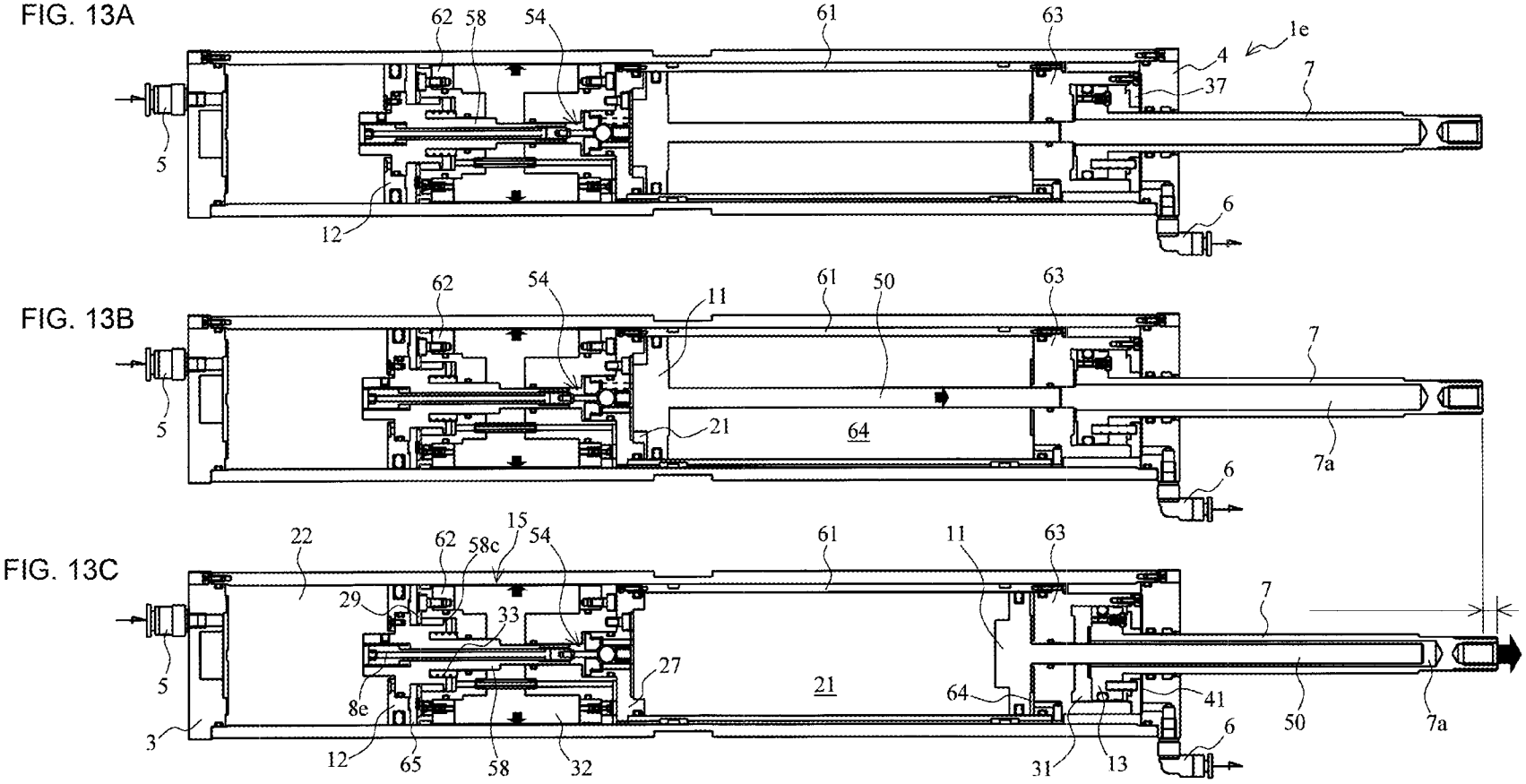
FIGS. 13A to 13C are views for illustrating another actuation state of the fifth embodiment.

FIGS. 13A to 13C illustrate states of the second actuation performed by the cylinder device 1*e*.

In the second actuation, the end portion (retaining ring 37*a*) of the piston housing 60 on the output side abuts on the lid 4 before the front end of the output rod 7 abuts on the workpiece 100, and thereby fixing of the piston housings 60 is formed. The fixing actuation and the automatic operation of the check valve 54 are continuously performed, and the amplified hydraulic pressure is output from the front end of the output rod 7.

In the second actuation in the sixth embodiment, the portions in the cylinder 2 are actuated from the initial state to states of FIGS. 13A to 13C in this order.

In the states in FIGS. 13A to 13C, the actuation of the second piston 12 and the rod portion 58, the piston housings 60 (61, 62, and 63), the first piston 11 and the rod portion 50, and the third piston 13 and the output rod 7, except for the check valve 54, is the same as the second actuation described in FIGS. 10A to 10C in the fifth embodiment.

On the other hand, the actuation of the check valve 54, the timing of opening the check valve 54, and the actuation of pressurizing the first pneumatic chamber 21 with the air of the first pneumatic chamber 21 is the same as the actuation of the check valve 54 described in FIGS. 12A to 12C.

However, regarding the fixing of the second housing 62 and the timing of opening the check valve 54, the communication rod 8*d* is adjusted such that the check valve 54 is slightly early opened, and the position of the opening/closing rod 54*a* is optimally set.

In addition, in a state in which the first pneumatic chamber 21 is pressurized, the first piston 11 and the rod portion 50 move in the cavity 7*a* in a forward direction, and the actuation of outputting the thrust from the front end of the output rod 7 is the same actuation described in FIG. 10C.

As illustrated in FIG. 13C, in the second actuation, since the first piston 11 significantly moves in the first housing 61 in the output direction, the actuation of returning to the initial state is as follows, unlike the case of the first actuation.

In a case where the cylinder device returns from the state in FIG. 13C to the initial state, the first inlet/outlet 5 is opened, and then the air is supplied from the second inlet/outlet 6 with predetermined pressure. The air supplied from the second inlet/outlet 6 is supplied to the third pneumatic chamber 41, the fourth pneumatic chamber 64, and the fifth pneumatic chamber 65.

On the other hand, the second piston 12 and the rod portion 58 do not receive the pneumatic pressure in the output direction by the second pneumatic chamber 22 due to the opening of the first inlet/outlet 5. Therefore, the pressurization by the air supplied to the fifth pneumatic chamber 65 and the bias force by the coil spring 33 cause the second piston 12 and the rod portion 58 to start moving in the input direction. In this manner, the fixing of the second housing 62 by the thin portion 15 is canceled.

The third pneumatic chamber 41 and the fourth pneumatic chamber 64 are pressurized due to the supply of the air from the second inlet/outlet 6, and a force acts on to cause the first housing 61 to move to the input side. Therefore, the fixing of the second housing 62 is canceled and, simultaneously, all of the piston housings 60 (61 to 63) move to the input side.

The movement of all of the piston housings 60 to the input side starts before the flange 58*c* abuts on the retaining ring 29 as long as the fixing of the second housing 62 is canceled.

At this time, the opening/closing rod 54*a* is set such that the check valve 54 is slightly opened even when the fixing of the second housing 62 is canceled. Therefore, the first piston 11 simultaneously starts to move to the input side inside the first housing 61.

The second piston 12 abuts on the lid 3, and all of the piston housings 60 are stopped.

Since the fourth pneumatic chamber 64 has already pressurized, the air of the first pneumatic chamber 21 passes through the check valve 54 and is discharged from the first inlet/outlet 5 through the communication channel 8*e*. In this manner, the first piston 11 moves to the input side. In addition, the output rod 7 also moves to the input side.

When the first piston 11 abuts on the lid 27 and the movement to the input side is completed, the second inlet/outlet 6 is opened. The completion of the movement of the first piston can be found with an exhaust flow rate of the air from the third inlet/outlet 8 or with the position of the output rod 7.

All of the piston housings 60 (61 to 63) start moving by the coil spring 33 and move to the output side until the check valve 54 is closed and the flange 58*c* abuts on the retaining ring 29, and the device comes into the initial state.

In the first actuation described in FIGS. 12A to 12C, since the movement of the first piston 11 is slight in the first housing 61, the first piston 11 completes the movement to the input side before the check valve 54 is closed. Therefore, the first inlet/outlet 5 is opened and the air is supplied from the second inlet/outlet 6, thereby returning to the initial state.

As described above, according to the sixth embodiment, the first inlet/outlet 5 is provided to increase the hydraulic pressure of the second hydraulic chamber 32 and to fix the piston housing 60 to the cylinder 2, and the fixing actuation and the opening of the check valve 54 are continuously performed.

It is possible to continuously perform the fixing of the piston housing 60 to the cylinder 2 and the outputting of the amplified thrust from the front end of the output rod 7 only with the supply of the air from the first inlet/outlet 5.

Also in the fifth embodiment and the sixth embodiment described above, it is possible to achieve effects of the first to fourth embodiments described above.

In addition, in the fifth embodiment and the sixth embodiment described above, the case where the piston housing 60 is fixed to the cylinder 2 with the thin portion 15 of the second housing 62 is described; however, similar to the third embodiment described in FIGS. 5A to 5D, the piston housing 60 may be fixed to the cylinder 2 by the clamper.

In addition, also in the fifth embodiment and the sixth embodiment described above, similar to the description in FIGS. 2AA to 2BD, it is possible to perform punching or forming a recessed portion by press working.

What is claimed is:

1. A cylinder device comprising:

a cylinder;

a pneumatic chamber formed on an input side of the cylinder;

a hydraulic chamber that moves to an output side of the cylinder due to pressure of the pneumatic chamber, wherein the hydraulic chamber includes a first hydraulic chamber and a second hydraulic chamber; and an output rod that outputs amplified hydraulic pressure that is generated in the first hydraulic chamber by pressurizing the first hydraulic chamber, wherein the cylinder device is configured to:

generate a first force in a radial direction by pressurizing the second hydraulic chamber; and fix the first hydraulic chamber and the second hydraulic chamber using the first force.

2. The cylinder device according to claim 1, wherein the hydraulic chamber is configured to:

generate hydraulic pressure using the first force at the output side and using a second force that is applied to the hydraulic chamber by the output rod.

3. The cylinder device according to claim 1, wherein the cylinder device is configured to fix the second hydraulic chamber and the first hydraulic chamber by pressing, to an inner wall of the cylinder, a side wall of the second hydraulic chamber that is elastically deformed using the first force in the radial direction.

4. The cylinder device according to claim 1, wherein the cylinder device is configured to:

generate a third force in the radial direction by pressing, to a clamper, a taper member moving in the thrust direction using hydraulic pressure of the second hydraulic chamber, and fix the second hydraulic chamber and the first hydraulic chamber by pressing the clamper to an inner wall of the cylinder using the third force.

5. The cylinder device according to claim 1, wherein the first hydraulic chamber has an output piston pressing the output rod toward the output side, the cylinder device further comprising:

biasing means that biases the output piston in a direction opposite to the output side.

6. The cylinder device according to claim 5, wherein the output piston of the first hydraulic chamber transmits only an output to the output rod without moving even in a state in which the amplified hydraulic pressure is applied to the output rod and thrust is output.

7. The cylinder device according to claim 6, wherein a rod portion of the first piston is divided into two rod portions provided with a predetermined clearance therebetween.

8. The cylinder device according to claim 1, wherein the pneumatic chamber includes a first pneumatic chamber having a first piston that pressurizes the first hydraulic chamber and a second pneumatic chamber having a second piston that pressurizes the second hydraulic chamber, wherein the second pneumatic chamber is disposed on the input side, and wherein the first pneumatic chamber is disposed on the output side, the cylinder device further comprising:

a first inlet/outlet for pressurizing the second pneumatic chamber; and a third inlet/outlet for pressurizing the first pneumatic chamber by penetrating through the second pneumatic chamber and the second hydraulic chamber.

9. The cylinder device according to claim 8 further comprising:

an input-side housing provided with the second hydraulic chamber; and an output-side housing provided with the first pneumatic chamber and the first hydraulic chamber, wherein the input-side housing is fixed to a first side of the output-side housing.

10. The cylinder device according to claim 9, wherein the second piston is disposed between the input-side housing and the second pneumatic chamber, makes movement to the output side due to pressure from the second pneumatic chamber, and has a rod portion that pressurizes the second hydraulic chamber due to the movement.

11. The cylinder device according to claim 10, wherein the third inlet/outlet penetrates through the second piston and the rod portion and penetrates through the second pneumatic chamber and the second hydraulic chamber.

12. The cylinder device according to claim 1, wherein the pneumatic chamber includes a first pneumatic chamber having a first piston that pressurizes the first hydraulic chamber and a second pneumatic chamber having a second piston that pressurizes the second hydraulic chamber, wherein the second pneumatic chamber is disposed on the input side, and wherein the first pneumatic chamber is disposed on the output side, the cylinder device further comprising:

a first inlet/outlet for pressurizing the second pneumatic chamber; and a communication hole which penetrates through the second hydraulic chamber and through which the first pneumatic chamber communicates with the second pneumatic chamber.

13. The cylinder device according to claim 12 further comprising:

an input-side housing provided with the second hydraulic chamber; and an output-side housing provided with the first pneumatic chamber and the first hydraulic chamber, wherein the input-side housing is fixed to a first side of the output-side housing, wherein the second piston is disposed between the input-side housing and the second pneumatic chamber, makes movement to the other end side due to pressure from the second pneumatic chamber, and has a rod portion that pressurizes the second hydraulic chamber due to the movement, wherein the communication hole is provided with a communication rod that penetrates through the second piston and the rod portion and is fixed to the second piston, and a valve mechanism disposed on a communication channel between the first pneumatic chamber and the second pneumatic chamber, and wherein the valve mechanism performs opening and closing in association with the movement of the communication rod moving along with the second piston.

14. The cylinder device according to claim 1, wherein the pneumatic chamber includes a first pneumatic chamber having a first piston that pressurizes the first hydraulic chamber, a second pneumatic chamber having a second piston that pressurizes the second hydraulic chamber, and a communication hole through which the first pneumatic chamber communicates with the second pneumatic chamber, and wherein the first pneumatic chamber has a first inlet/outlet and is formed on the input side.

15. The cylinder device according to claim 14, further comprising:

a pneumatic rod that is formed from the first piston to the input side by penetrating through the first pneumatic chamber.

16. The cylinder device according to claim 14, wherein the first piston causes the second pneumatic chamber, the first hydraulic chamber, and the second hydraulic chamber to move to the output side until the output rod abuts on a workpiece or until the first hydraulic chamber reaches an end portion on the output side to which the first hydraulic chamber is movable, with pressure of the first pneumatic chamber.

17. The cylinder device according to claim 16, wherein a movement distance of the second piston is set within a range of a length of elastic deformation of a seal member of the second hydraulic chamber, wherein the movement distance of the second piston is measured when the second piston generates the hydraulic pressure of the second hydraulic chamber.

18. The cylinder device according to claim 16, wherein the first hydraulic chamber is formed on the output, and wherein the first piston is formed on the first hydraulic chamber by penetrating through the second pneumatic chamber and the second hydraulic chamber.

19. The cylinder device according to claim 16, further comprising:

a third pneumatic chamber that is provided on the output side, wherein the third pneumatic chamber has a second inlet/outlet, and presses the first hydraulic chamber and the second hydraulic chamber to the input side.

20. A press machine comprising:

the cylinder device according to claim 19; and workpiece mounting means for mounting the workpiece at a predetermined position with respect to the cylinder device, wherein the press machine is configured to:

press the mounted workpiece with a tool disposed on the output rod by driving the cylinder device; and detach the pressed workpiece from the predetermined position.

21. A workpiece clamping apparatus comprising:

the cylinder device according to claim 19; and workpiece mounting means for mounting the workpiece at a predetermined position with respect to the cylinder device, wherein the workpiece clamping apparatus is configured to:

press and clamp the mounted workpiece with the output rod by driving the cylinder device; and detach the clamped workpiece from the predetermined position.

22. A cylinder device actuating method for actuating the cylinder device according to claim 19, the method comprising:

a first step of setting an initial state by causing the first hydraulic chamber and the second hydraulic chamber to move to the input side by pressurizing the third pneumatic chamber from the second inlet/outlet and depressurizing the first pneumatic chamber and the second pneumatic chamber from the first inlet/outlet;

a second step of causing the output rod to abut on the workpiece or causing the first hydraulic chamber to reach the end portion on the output side to which the first hydraulic chamber is movable by causing the first pneumatic chamber and the second pneumatic chamber to move to the output side by pressurizing the first pneumatic chamber and the second pneumatic chamber from the first inlet/outlet and depressurizing the third pneumatic chamber from the second inlet/outlet;

a third step of fixing the first hydraulic chamber and the second hydraulic chamber to the cylinder by further performing pressurization from the first inlet/outlet;

a fourth step of amplifying the hydraulic pressure by further performing pressurization from the first inlet/outlet and pressing the output rod to the workpiece; and a fifth step of returning to the initial state by causing the first hydraulic chamber and the second hydraulic chamber to move to the input side by pressurizing the third pneumatic chamber from the second inlet/outlet and depressurizing the first pneumatic chamber and the second pneumatic chamber from the first inlet/outlet.

23. A method for clamping the workpiece at a predetermined position by actuating the cylinder device according to claim 19, the method comprising:

a first step of mounting the workpiece at the predetermined position;

a second step of moving the output rod by the pressure of the first pneumatic chamber, until the output rod abuts and stops on the workpiece or until the first hydraulic chamber reaches and stops on an end portion on the output side to which the first hydraulic chamber is movable;

a third step of fixing the first hydraulic chamber and the second hydraulic chamber;

a fourth step of amplifying hydraulic pressure of the first hydraulic chamber; and a fifth step of clamping the workpiece at the predetermined position by pressing the workpiece by the output rod due to the hydraulic pressure amplified in the fourth step.

24. A method for pressing the workpiece by actuating the press machine according to claim 20, the method comprising:

a first step of returning a position of the output rod to an initial state;

a second step of mounting the workpiece at the predetermined position;

a third step of moving the output rod by the pressure of the first pneumatic chamber, until the output rod abuts and stops on the workpiece or until the first hydraulic chamber reaches and stops on an end portion on the output side to which the first hydraulic chamber is movable;

a fourth step of fixing the first hydraulic chamber and the second hydraulic chamber;

a fifth step of amplifying hydraulic pressure of the first hydraulic chamber;

a sixth step of pressing the workpiece due to hydraulic pressure with the tool disposed on the output rod, due to the hydraulic pressure amplified in the fifth step;

a seventh step of detaching the output rod and the tool disposed on the output rod from the workpiece due to pneumatic pressure; and an eighth step of detaching the pressed workpiece from the predetermined position.

25. A cylinder device actuating method for actuating the cylinder device according to claim 11, the method comprising:

a moving step of causing the second piston, the input-side housing, and the output-side housing to move to the output side by pressurizing the second pneumatic chamber from the first inlet/outlet;

a movement stopping step of stopping the movement of the input-side housing and the output-side housing by causing the output rod to abut on a workpiece or causing an output-side end portion of the output-side housing to abut on an end portion of the cylinder on the other side;

a fixing step of pressurizing the second hydraulic chamber from the first inlet/outlet so as to cause the second piston to move to the output side such that the rod portion pressurizes the second hydraulic chamber and fixing the input-side housing and the output-side housing to the cylinder; and a thrust generating step of pressurizing the first pneumatic chamber from the third inlet/outlet after the fixing and generating thrust due to the hydraulic pressure amplified from a front end of the output rod.

26. A cylinder device actuating method for actuating the cylinder device according to claim 13, the method comprising:

a moving step of causing the second piston, the input-side housing, and the output-side housing to move to the output side by pressurizing the second pneumatic chamber from the first inlet/outlet;

a movement stopping step of stopping the movement of the input-side housing and the output-side housing by causing the output rod to abut on a workpiece or causing an output-side end portion of the output-side housing to abut on an end portion of the cylinder on the other side;

a fixing step of pressurizing the second hydraulic chamber from the first inlet/outlet so as to cause the second piston to move to the output side such that the rod portion pressurizes the second hydraulic chamber and fixing the input-side housing and the output-side housing to the cylinder; and a communicating step of opening the valve mechanism and causing the second pneumatic chamber and the first pneumatic chamber to communicate to each other by further pressurizing the second pneumatic chamber from the first inlet/outlet so as to cause the communication rod to move to the other end side along with the second piston after the fixing in the fixing step; and a thrust generating step of pressurizing the communicated first pneumatic chamber from the first inlet/outlet after the communicating in the communicating step and generating thrust due to the hydraulic pressure amplified from a front end of the output rod.

* * * * *